US005127586A

United States Patent [19]

Oder

[11] Patent Number: 5,127,586

[45] Date of Patent: Jul. 7, 1992

[54] METHOD OF MAGNETIC SEPARATION AND APPARATUS THEREFORE

[75] Inventor: Robin R. Oder, Export, Pa.

[73] Assignee: Exprotech Company, Inc., New Kensington, Pa.

[21] Appl. No.: 662,724

[22] Filed: Feb. 28, 1991

Related U.S. Application Data

[60] Division of Ser. No. 462,331, Dec. 21, 1989, Pat. No. 4,017,283, which is a continuation of Ser. No. 251,111, Sep. 28, 1988, abandoned.

[51] Int. Cl.[5] ..... B02C 23/08; B07B 13/00; B03C 1/035

[52] U.S. Cl. ..... 241/24; 44/622; 44/627; 209/2; 209/3; 209/10; 209/38; 209/212; 209/214; 241/79.1

[58] Field of Search ..... 241/24, 79.1; 209/1-3, 209/8, 10, 38, 212-214; 44/505, 608, 620-622, 627

[56] References Cited

U.S. PATENT DOCUMENTS

| | | | |
|---|---|---|---|
| 1,999,825 | 4/1935 | Saklatwalla et al. | 241/24 X |
| 2,269,912 | 1/1942 | Ladoo et al. | 241/24 |
| 2,765,074 | 10/1956 | Diamond | 209/214 X |
| 3,022,956 | 2/1962 | Haseman | 209/215 X |
| 3,625,354 | 12/1971 | Heitmann | 209/38 X |
| 3,684,090 | 8/1972 | Kilbride | 209/214 |
| 5,035,365 | 7/1991 | Birmingham | 242/24 X |

*Primary Examiner*—Michael S. Huppert
*Assistant Examiner*—Edward M. Wacyra
*Attorney, Agent, or Firm*—Michael J. Kline

[57] ABSTRACT

A method and apparatus for magnetically beneficiating a raw sample, such as coal or lunar soil is disclosed. The beneficiation is achieved using a novel of fractionating the sample into components of different magnetic susceptibilities. The results of the fractionation may be used to determine the type of magnet to be employed for large scale operations, as well as the appropriate fraction or fractions to be recovered for further processing.

5 Claims, 17 Drawing Sheets

METHOD OF MAGNETIC SEPARATION AND APPARATUS THEREFORE

This is a division of application Ser. No. 07/462,331, filed Dec. 21, 1989, now U.S. Pat. No. 5,017,283, which is a file wrapper continuation of Ser. No. 07/251,111, filed Sept. 28, 1988, now abandoned.

FIELD OF THE INVENTION

The present invention relates to a method of beneficiating particulate material such as coal for recovery of low sulfur and low ash clean coal for direct combustion and to a method of magnetic processing of particulate extraterrestrial material such as lunar soil for recovery of valuable components such as anorthite (as a feedstock for production of oxygen, silicon, aluminum, and calcium), ilmenite (as a feedstock for recovery of oxygen, titanium, iron, Helium-3, and sulfur), agglutinates for recovery of native iron, and glassy and other components for recovery of materials for construction, such as cement and glass.

BACKGROUND OF THE INVENTION

The use of dry magnetic methods in the cleaning of coal is of interest because of the potential for efficient separation of pyritic sulfur by a safe, environmentally acceptable and inexpensive dry process. The scientific basis for the method is unquestioned: the carbonaceous structure of the coal is diamagnetic and the principal sulfur-bearing minerals, iron pyrite and iron sulfate, are paramagnetic. Additionally, many ash-bearing "non-magnetic" minerals, such as quartz and shale, can also be separated from coal by magnetic methods because they can be made weakly paramagnetic by small amounts of iron impurity naturally associated with these minerals.

Both wet and dry magnetic coal cleaning methods have been investigated over the past twenty years. In spite of this effort, however, magnetic separation methods have not been applied to commercial cleaning of coal because (1) there has been a lack of technical information on the distribution of magnetic material in American coals, and (2) it has not previously been economically feasible to scale up conventional electromagnet technology for application to coal processing. Recent developments in the areas of coal characterization and high field magnet design have made favorable changes in both of these areas.

Presently there are plans both in private industry and in government to build and man stations in space and/or on the earth's moon. Such stations would require an oxygen supply for all inhabitants, both plant and animal. It would be useful to utilize oxygen-containing minerals and ores on the moon for the production of such oxygen.

Additionally, it would be desirable to utilize minerals on the earth's moon for the production of metals, such as iron, calcium, silicon, aluminum, etc., which could be used in situ, or in connection with building a space station or back on earth. Because of the moon's feeble gravitational pull, roughly one sixth that of earth's, it may be far less cumbersome to transport raw building materials produced on the moon to a space station than to transport those same raw materials from earth. Of course, such advantages are further magnified when the materials are used for building purposes on the moon itself.

The lunar soil is known to contain small amounts of the odd isotope of helium, Helium-3, which could be used as a clean burning fuel with deuterium in fusion reactions for generation of electricity on earth or for generation of propulsion power in space. This is of profound significance for the future of mankind because there is enough of this material in the lunar soil to supply the electrical needs of the U.S. for centuries to come if it can be recovered. Present schemes call for use of an inefficient thermal devolatilization process for treating the entire lunar soil [I. N. Sviatoslavsky and M. Jacobs, "Mobile Helium-3 Mining and Extraction System and its Benefits toward Lunar Base Self-Sufficiency," appearing in Engineering, Construction, and Operations in Space, Proceedings of Space 88, ed. by Stewart W. Johnson and J. P. Wetzel, published by the American Society of Civil Engineers, 345 East 47th Street, New York, N.Y. 10017-2398, p. 310 (1988)]. The Helium-3 is known to be concentrated in the mineral ilmenite ($FeTiO_3$) which is found in abundance in lunar mare soils. Concentration of the ilmenite for feedstock to the devolatilization process could greatly reduce the destruction of the lunar surface while significantly improving the technical and economic feasibility of the recovery process. Presently, there are no known processes for concentration of the ilmenite in lunar soils.

On the earth's moon there are several types of mineral matter and ores which could function as feed stocks for processes that would produce oxygen, metals such as iron and silicon, and nuclear fusion fuel such as Helium-3. However, there is presently no commercially feasible method of beneficiating such materials to concentrate the magnetic elements and compounds which would make separation of these elements and materials possible.

Magnetic methods are preferred in the beneficiation of extraterrestrial material because of the unique nature of the lunar regolith and because dry processing is desired. There is no water on the surface of the moon, hence the need for dry soil processing methods. Further, there is no atmosphere on the surface of the moon and virtually no free oxygen is present. Because of this, one does not observe the 3+ oxidation states of ferromagnetic elements such as iron, $Fe^{3+}$. This, plus the unique presence of solar wind implanted hydrogen, have created unusual components in the lunar soils. The lunar soil has been finely pulverized by meteorite impact throughout millions of years. The impacts release heat and create glassy components and irregular shaped agglutinates containing elemental iron. The agglutinate fractions and "native iron" inclusions are unique to the lunar soil. The agglutinates are a potential source of reduced iron.

At present, there is no single source of information quantifying the distribution of magnetic materials in either terrestrial or extraterrestrial materials. Because of this, researchers and engineers usually plan for some form of testing using available technology in their efforts to determine the feasibility of magnetic beneficiation for their application. This approach yields results which are specific to the beneficiation apparatus at best and yields no analytical basis for extrapolating the test results.

This empirical approach is acceptable in conventional applications where a variety of commercial separators can be tested and where a sufficient supply of test material is available. The method is inadequate, however, in cases where innovative separations technology may be necessary and where the supply of test materials is severely limited, such as lunar soil samples. Most magnetic separators are intended for specific applications and the empirical design procedures employed by the manufacturer cannot be extended beyond the present usage. Indeed, most vendors simply do not know enough about magnetic materials or magnetic separator design to be able to extrapolate to new applications, such as those involving extraterrestrial matter.

At any rate, this empirical approach cannot be used in projecting technology needs for processing lunar soils because these materials are not available in sufficient quantity for this testing and because no lunar simulant suitable for magnetic purposes exists. The agglutinate fraction, which is important to magnetic beneficiation of lunar soils, is unique to the moon because of the presence of the hydrogen reduced iron.

SUMMARY OF THE INVENTION

The present invention relates to a method of dry magnetic separation of particulate material. It is applicable to dry beneficiation of coal and extraterrestrial ores on a large volume basis. This work makes feasible the preparation of clean burning fuels from coal for direct combustion and also makes use of beneficiated lunar ores as a feedstock for the production of oxygen, iron, Helium-3, calcium, aluminum, silicon, and other elements. The ore is beneficiated using a magnetic separator, which is preferably used to remove several fractions of magnetic matter from the product, in one preferred embodiment of the invention, by beginning with the most highly magnetic fraction and proceeding through less magnetic fractions. In another preferred embodiment of the invention, the fractions are separated in a single pass through the magnetic separator, employing a novel splitter means.

BRIEF DESCRIPTION OF THE DRAWINGS

In the accompanying drawings, the preferred embodiments of the invention and preferred methods of practicing the invention are illustrated in which.

Other details, objects and advantages of the invention will become apparent as the following description of the presently preferred embodiments and presently preferred methods of practicing the invention proceeds.

DETAILED DESCRIPTION OF THE INVENTION

The first and most fundamental type of information that is developed when assessing the feasibility of applying magnetic beneficiation methods concerns the magnetism of the materials to be separated. Most laboratory magnetic separators suitable for dry processing can be configured and calibrated for making direct measurements of magnetic susceptibility of the materials which they have separated. Further, some separators can be operated so as to separate materials of differing levels of magnetism ranging from diamagnetism to strongly magnetic material such as ferromagnets. Using the materials separated it is possible to correlate physical and chemical characteristics of the isolates with their magnetic susceptibilities and thus determine the distribution of magnetics in the system of interest. This type of relationship is referred to herein as a "MagnetoGraph".

The MagnetoGraph is used according to the present invention to quantify the degree of magnetism of the materials to be processed, to specify the type and performance of the magnetic separator used to carry out the separations on a large scale, and to develop a procedure for making the separations.

Figure 1:
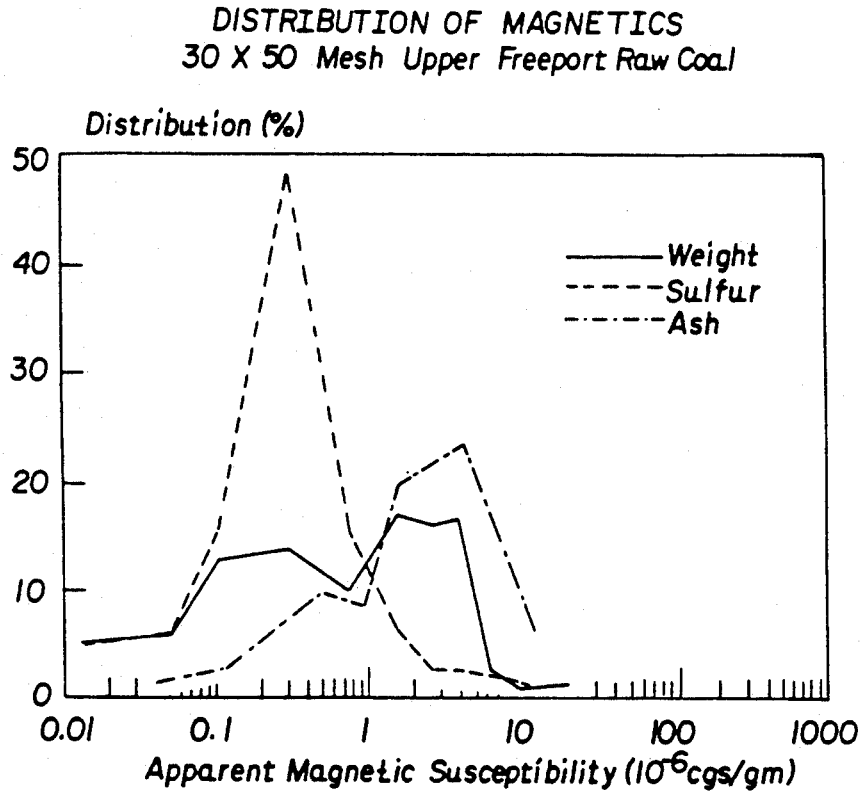
FIG. 1 is a MagnetoGraph relating sulfur and ash content to magnetic susceptibility for an Upper Freeport coal sample.

An example of a MagnetoGraph relating sulfur and "ash" to magnetic susceptibility for coal is illustrated in FIG. 1. The techniques for preparing MagnetoGraphs are discussed in R. R. Oder, "Dry Magnetic Beneficiation of Pennsylvania Coal," Proceedings of the Fourth Annual Pittsburgh Coal Conference, hosted by the University of Pittsburgh School of Engineering, Pittsburgh, Pa. (1987), pp. 359-371.

The information shown in FIG. 1 can be developed in a variety of ways with different magnetic separators. The procedure is to a certain extent analogous to float and sink analysis for gravimetric cleaning of coal and other minerals. In this procedure, the magnetic susceptibility is the analog of the specific gravity difference and the magnetic force is the analog of the buoyancy force employed in a washability study.

For the case of the coal shown in FIG. 1, the magnetic separator must be capable of separating paramagnetic minerals, with susceptibilities as low as $+0.3\times10^{-6}$ cc/gm if a significant quantity of sulfur-bearing iron pyrite is to be removed. If the goal of the beneficiation is ash removal only, however, then it is sufficient, for this coal, that the separator be capable of removing material with magnetic susceptibility greater than about $3\times10^{-6}$ cgs/gm.

The two types of magnetic separators which meet these dissimilar requirements are vastly different in physical configuration and costs. A knowledge of the distribution of magnetics as provided by the MagnetoGraph is thus necessary in choosing between these and other options. The present invention provides a method for developing and applying this type information on a broad basis.

The present invention utilizes a magnetic separator that can be operated so as to produce a variety of products of differing magnetic susceptibility: We will illustrate this method in measurements made in two different modes of operation of a single electromagnet supplied by the S. G. Frantz Company of Trenton, N.J.

The procedure first requires that the electromagnet be calibrated so that magnetic energy gradients can be determined. Next, the separator is operated so as to produce a plurality of sample fractions of differing magnetic susceptibilities. Two different modes of operation of the separator which produce this plurality of fractions are employed. Next, means must be incorporated to measure the magnetic susceptibility ranges and the relevant chemical and physical properties of the separated fractions. These characteristics are then related in the MagnetoGraph. Lastly, means are employed whereby the result of the MagnetoGraph is used to determine the physical and magnetic characteristics of a magnetic separator to process tested materials on a large scale.

CALIBRATION OF MAGNETIC SEPARATOR

The non-uniform magnetic field produced by magnetic separators can be used to measure the magnetic susceptibility of particles. The normal procedure in calibrating a device such as the Frantz Isodynamic Separator (Model L-1, S. G. Frantz Company, Trenton, N.J.) is to make separations of particles of known magnetic susceptibility, such as paramagnetic salts, and from the results of these measurements to establish an empirical relationship between the magnetic force and the energizing current supplied to the electromagnet. A method for calibrating the Frantz Isodynamic Separator based on the use of paramagnetic salts has been given by J. McAndrew, Proc. Aus. I.M.M., No. 181, pp. 59-73 (March, 1957). This method is limited to magnetic fields which are about one half that which the Frantz electromagnet can produce.

This method is difficult to apply to studies of weakly magnetic materials such as coal and lunar soils, however, because of problems associated with the hysteresis and saturation of the iron in the electromagnet employed to produce the magnetic field. High magnetic fields are required in separating and analyzing weakly magnetic material and the non-linear and hysteretic effects are most pronounced when iron-based electromagnets are operated near saturation.

Recently, a method of calibrating a Frantz Isodynamic Separator has been reported [J. E. Nessett and J. A. Finch, Trans. Inst. Min. Metall. (Section C: Mineral Process. Extr. Metall.) 89, p. C161 (December, 1980)] which is based on the assumption that the field throughout the separating region of interest is "isodynamic". It was shown that the Frantz can be used in studies of field dependent susceptibilities of strongly magnetic material.

In the method of calibration described here, the problems associated with the non-linearity of iron based electromagnets have been circumvented by using measured values of the magnetic field to calculate magnetic forces from first principles. With this method, the iron-based Frantz electromagnet can be used conveniently at up to full field strength to carry out analytical separations of feebly magnetic material. No assumptions are required and calibrations employing cumbersome standard materials are avoided.

MAGNETIC FORCES

The x-component of the magnetic force on a particle with field independent susceptibility, $\chi$(cc/gm), in a spatially nonuniform magnetic field, H (Gauss), is given by, $$Fm = m\,\chi H\,\partial H/\partial X \text{ (dynes)} \qquad [1]$$

where m is the particle mass (grams) and $\partial H/\partial X$ is the gradient of the magnetic field strength along the x axis (Gauss/cm). If the energy gradient of the magnetic field, $$\text{Magnetic Energy Gradient} = \tfrac{1}{2}\partial H^2/\partial X \text{ (Gauss2/cm)} \quad [2]$$

is known at the site of the particles, then the magnetic susceptibility can be determined from a measurement of the magnetic force and the mass of the particle.

MAGNETIC FIELD MEASUREMENTS

The Frantz Isodynamic Separator produces a magnetic field of near-constant magnetic energy gradient throughout a portion of the volume between the separator's poles. Magnetic separations made in this region are readily amenable to analysis because the magnetic force is approximately the same for all particles of similar magnetic susceptibility.

Figure 2:
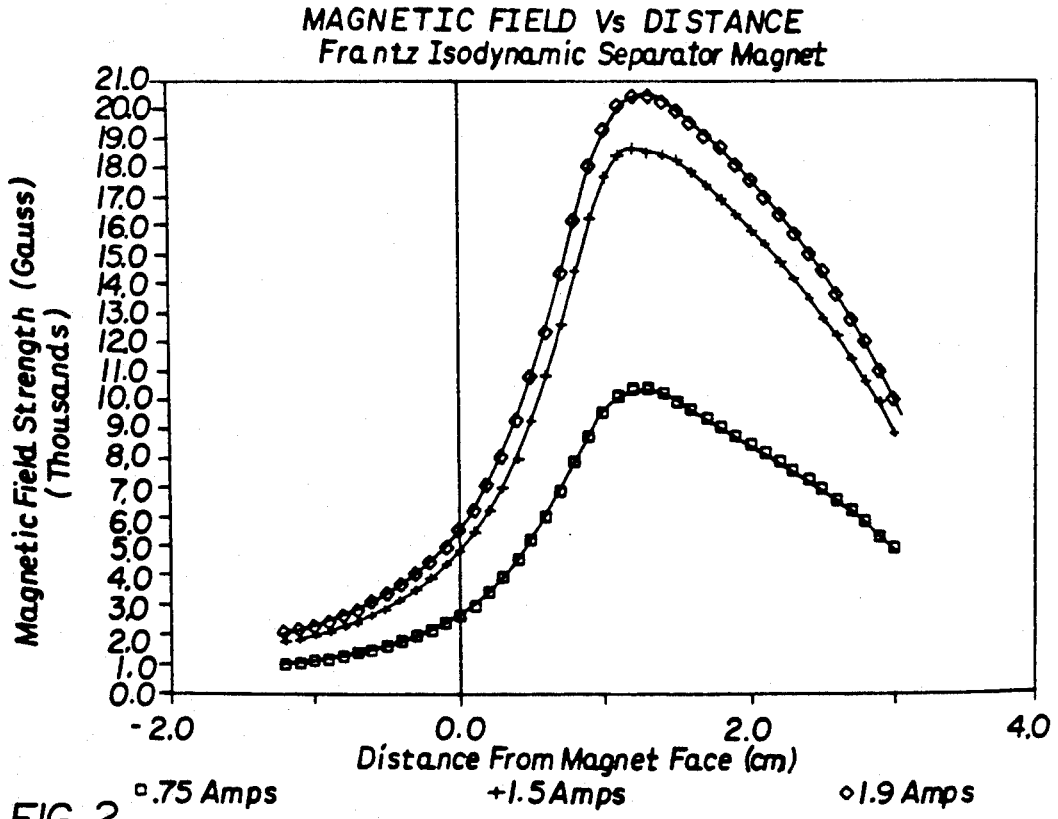
FIG. 2 is a magnetic field profile for the Frantz Isodynamic Electromagnet.

Measurements of the magnetic field at three levels of the magnet current made along a line from front to back of the Frantz electromagnet are shown in FIG. 2. The line of measurement was located in the center plane between the magnet poles at a height corresponding to the location of the splitter at the exit end of the tray. At a current of 1.9 amperes the electromagnet is near saturation.

The magnetic fields, which were produced on the increasing current leg of the magnet's full-current hysteresis curve, were measured with an F. W. Bell Model 600 Hall probe gaussmeter. The thin-film Hall probe, mounted in a 1 mm thick phenolic laminate, had an active area of 1.8 mm diameter. The accuracy of the gauss meter was 3% of full scale to 30,000 gauss.

Figure 3:
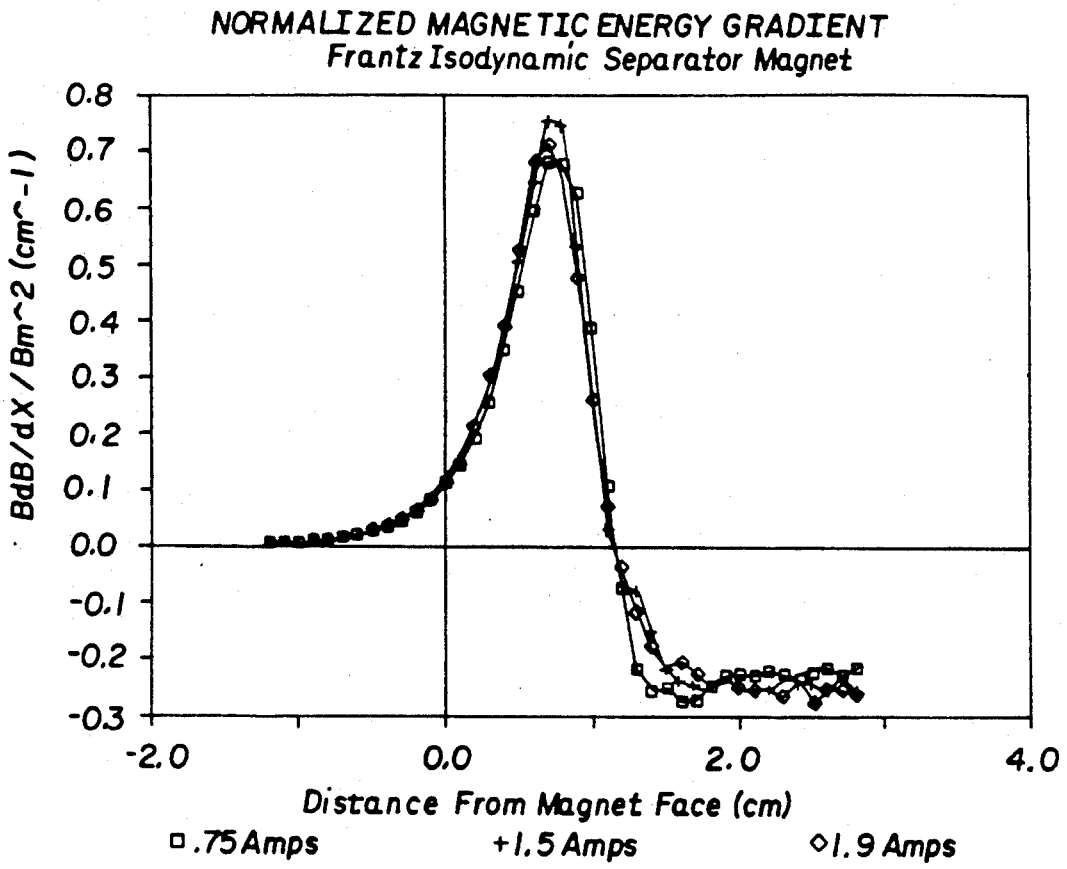
FIG. 3 is a plot illustrating the magnet current dependence of the normalized magnetic energy gradient profile of the Frantz Isodynamic Electromagnet.

The normalized magnetic energy gradient has been calculated from the data shown in FIG. 2 using Equation 2 and is shown plotted in FIG. 3. In FIG. 3, the calculated values of the energy gradient have been divided by the square of the maximum magnetic field strength, $B_m$, produced in the electromagnet gap at the magnet currents considered. This is the normalized magnetic energy gradient.

It is evident that in the region between the poles towards the back of the magnet at a distance greater than 1 cm from the face the normalized magnetic energy gradient is approximately independent of magnetic field strength and distance along the axis. In this region, $$\text{"isodynamic" energy gradient} = -0.245\ Bm^2 \text{ (Gauss}^2\text{/cm)} \quad [3]$$

The magnetic energy gradient in the "isodynamic" region varies by less than 3%, as the magnetic field produced by the electromagnet is increased from the remanent field (approximately 100 gauss) to a maximum field of approximately 20500 gauss. Therefore, the normalized magnetic energy gradient curve of FIG. 3 is independent of magnet current so long as one operates on the same leg of the magnet hysteresis curve.

Use of the universal relationship of Eq. (3) greatly simplifies quantitative measurements of magnetic susceptibility and eliminates the need for elaborate calibrations of the nonlinear relationship between magnetic force and magnet current based on use of cumbersome reference materials. The method of calibration of the magnetic separator used in the method of this inventor requires measurement of a magnetic field strength only. It is possible to instrument the Frantz electromagnet for control by magnetic field, or the field-current calibration can be used to determine the current level to produce the desired field strength. Either way, forces are then determined with use of Eq. (1).

As is apparent from FIG. 3, large magnetic forces are developed in the "non-isodynamic" region near the face of the electromagnet where the magnetic field gradients are higher. The average normalized "maximum" magnetic energy gradient for the Frantz electromagnet is $$\text{"maximum" energy gradient} = +0.73\ B^2_m \pm 4\% \text{ (gauss2/cm)} \quad [5]$$

This higher level force can be very effective in magnetic separations of feebly magnetic material.

Figure 4:
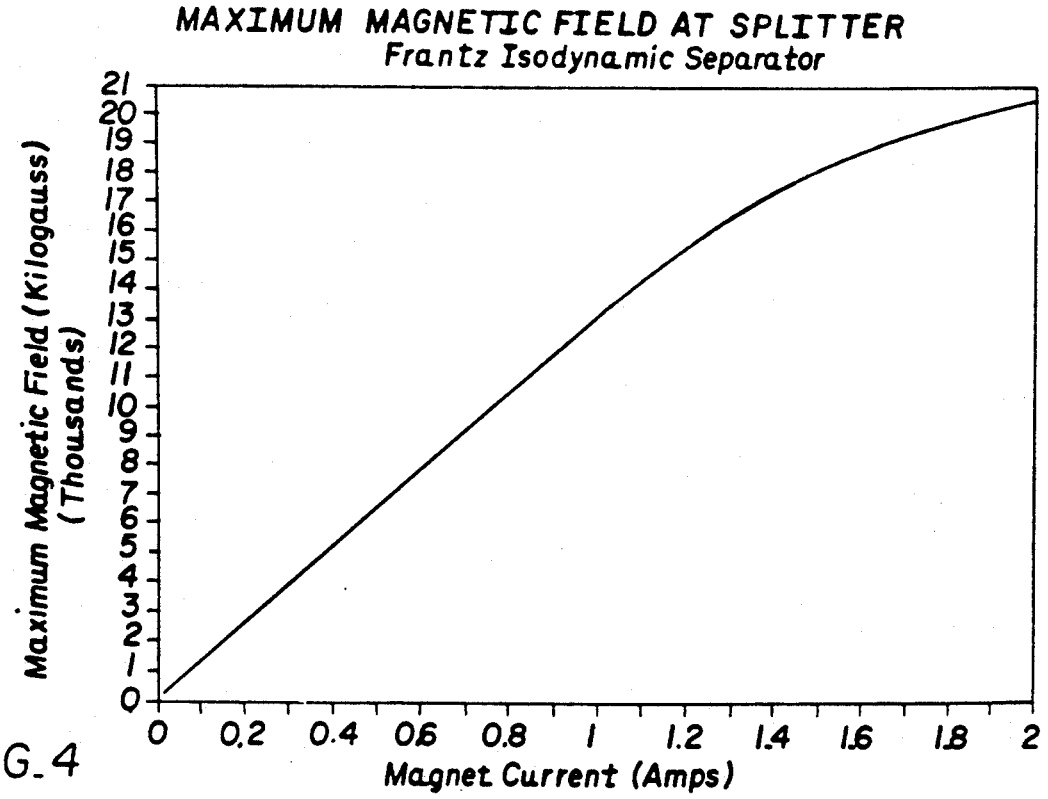
FIG. 4 is a plot illustrating the relationship between magnet current and maximum magnetic field strength for the Frantz electromagnet.

Once the relationship between magnet current and maximum magnetic field strength has been determined, the magnetic field, the magnetic field gradient, and the magnetic energy gradient can be determined anywhere along the measurement line using the universal curves of FIG. 3. This observation greatly simplifies quantitative measurement with the Frantz. The relationship between magnet current and maximum magnetic field strength for the separator employed in this work is shown in FIG. 4.

MAGNETIC SEPARATIONS

Processing on the tray of the Frantz separator achieves quantitative separation of weakly magnetic particles by balancing the magnetic force against a component of particle weight when the particles are constrained to move on the surface of the tray located between the magnet poles. A description of the tray operation of the Frantz Isodynamic Separator has been given by J. McAndrew, Proc. Aus. I.M.M., No. 181, pp. 59–73 (March, 1957).

In this arrangement, the magnet and tray are tipped forward together to make the particles slide. The magnet/tray arrangement can also be tilted sideways making an angle $\theta$(deg) with respect to the horizontal. This results in a component of the particle weight, mgSin $\theta$, directed transverse to the length of the tray. This force causes the particles to slide across the tray as they move downward through the separator.

Figure 5:
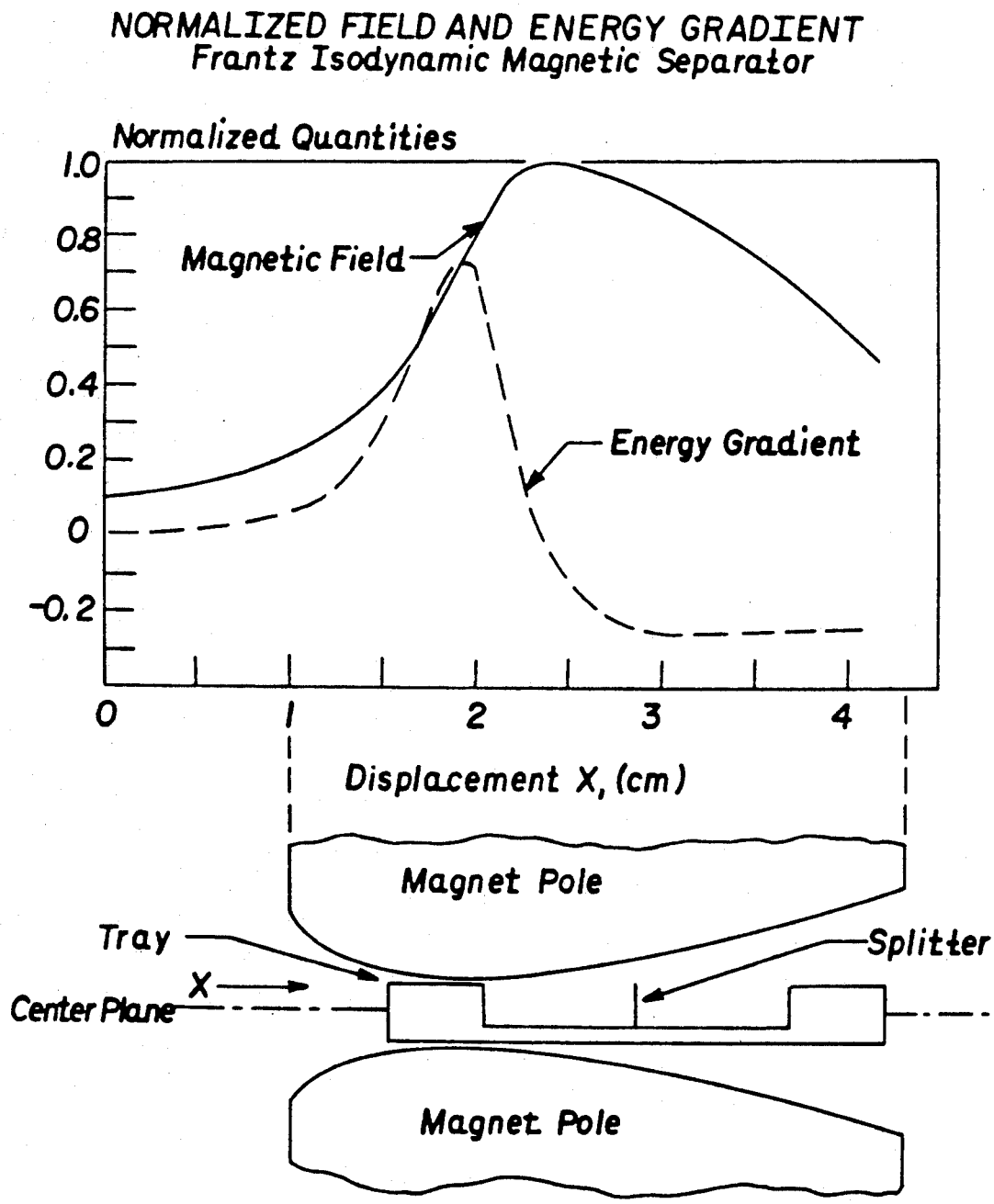
FIG. 5 is a plot illustrating the relationship between the location of the tray and the magnetic fields in the gap of a Frantz Isodynamic Separator.
Figure 6A:
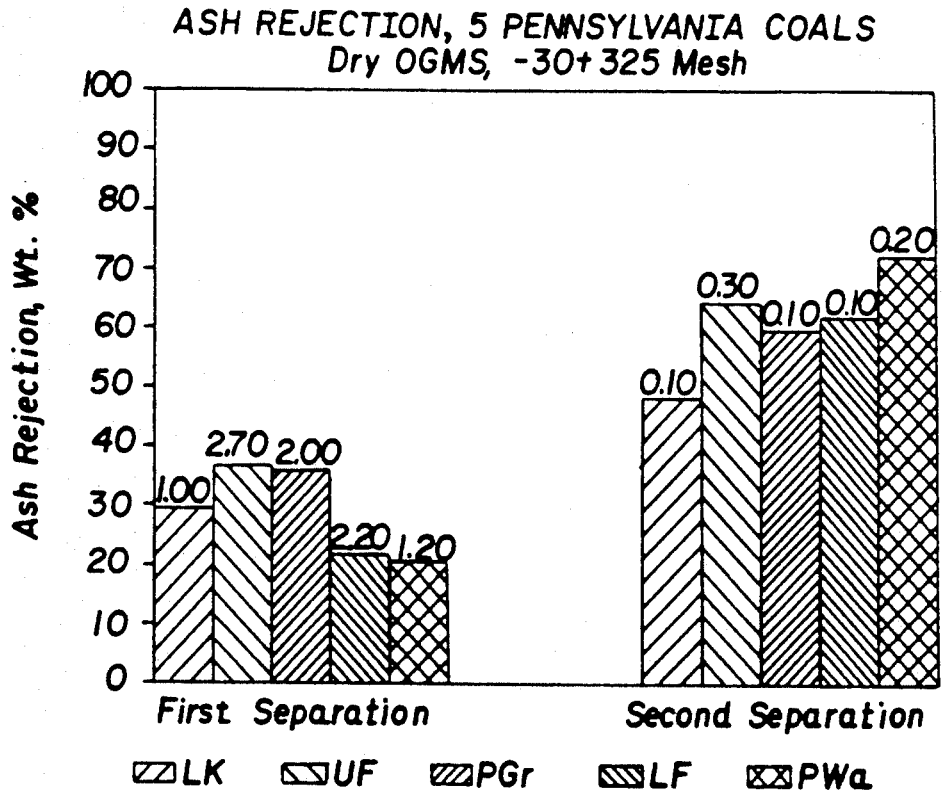
FIG. 6*a* and 6*b* illustrate MagnetoGraphs of ash and sulfur for five Pennsylvania coals.
Figure 6B:
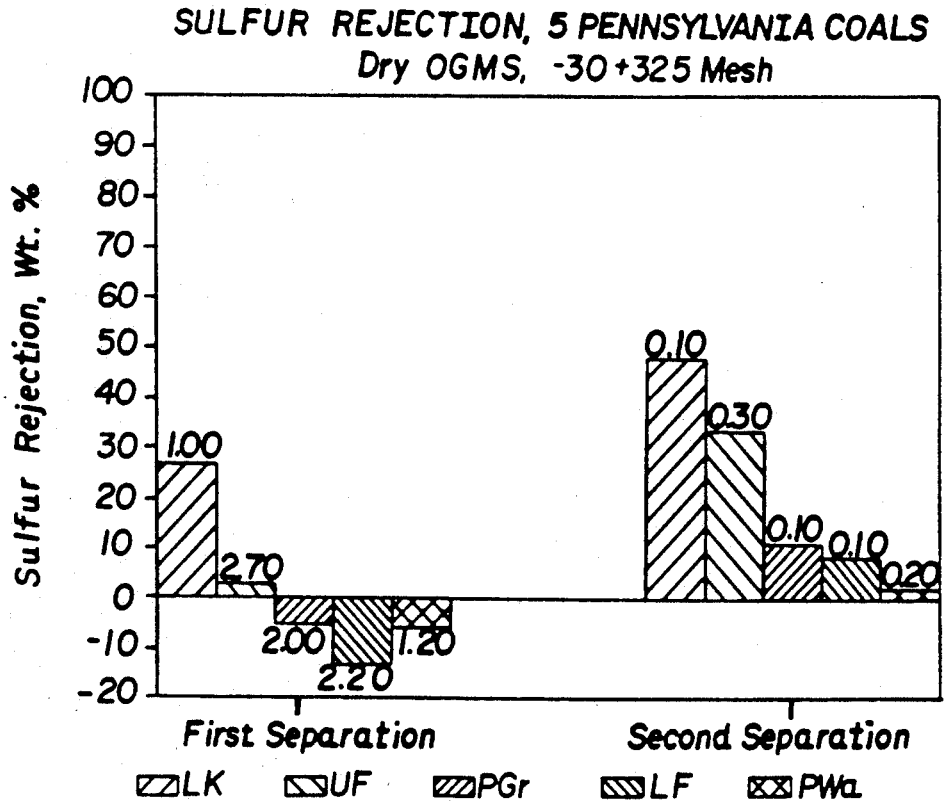

The magnetic force can be balanced against the lateral component of the particle weight by adjustment of the magnetic field strength and the side slope. Under this condition, particles will exit the separator with different lateral displacements depending upon their magnetic susceptibilities. A splitter located near the downstream end of the tray makes a single separation of "more strongly magnetic" from "less strongly magnetic" particles as they emerge from the magnet. The splitter, is located along the tray center line at the exit end of the tray. The relationship between magnetic field and the location of the tray are shown in FIG. 5.

In using the tray arrangement to construct a MagnetoGraph, according to one embodiment of the invention, a multiplicity of successive runs is employed to separate material which is of differing levels of magnetism. The tray arrangement is configured to separate a raw sample into a strongly magnetic fraction and a "nonmagnetic" fraction, which of course has a magnetic susceptibility, albeit less than the strongly magnetic fraction. This first separation is accomplished in the first pass by using a combination of high values of the side slope and low values of the magnetic field strength. The "nonmagnetic" fraction from the first pass is then reprocessed under conditions designed to separate material less magnetic than that removed in the first pass. This procedure is repeated until only "diamagnetic" material remains.

At this point in the procedure, the tray arrangement is reconfigured so that the most strongly diamagnetic material will be separated. This uses a relatively high value of side slope with an opposite sense than that used for the paramagnetic separation and relatively low values of the magnetic field strength. The "relatively non-diamagnetic" fraction from this pass is then reprocessed under conditions designed to separate material less diamagnetic than that removed in the preceding pass. This procedure is repeated until no material remains. The isolates obtained in each of the separation steps described above are then analyzed for weight, magnetic susceptibility, and relevant chemical and physical characteristics.

COAL MAGNETOGRAPHS

A typical MagnetoGraph analysis of a 30×50 mesh size fraction of the magnetic isolates taken from Upper Freeport Seam raw coal from Armstrong County, Pa. is shown in Table I. The data are illustrated in FIG. 1. The raw coal ash was 23.2% and the total sulfur was 1.86%, both on a dry basis.

The apparent magnetic susceptibility of separation is shown in the left column of Table I. These numbers have been calculated from the combination of magnetic field strength and side slope employed in the tray configuration. They represent a range of susceptibilities of the material which was separated. For example, the first pass through the separator removed material with magnetic susceptibility greater than $20\times10^{-6}$ cc/gram. The second pass removed particles with susceptibilities between $9.7\times10^{-6}$ cc/gram and $20\times10^{-6}$ cc/gram, and so on.

TABLE I

DISTRIBUTION OF MAGNETICS IN 30 × 50 MESH UPPER FREEPORT SEAM RAW COAL FROM ARMSTRONG COUNTY, PENNSYLVANIA

| Apparent Magnetic Susceptibility $10^{-6}$ cc/gm | Weight Recovery Wt. %, Dry Basis | Ash wt % | Sulfur wt % |
|---|---|---|---|
| >20 | 0.4 | | |
| >9.7 < 20 | 0.3 | | |
| >6.1 < 9.7 | 0.8 | 84.2 | 1.33 |
| >3.9 < 6.1 | 4.9 | 90.0 | 0.66 |
| >2.6 < 3.9 | 4.5 | 86.9 | 0.68 |
| >1.5 < 2.6 | 4.5 | 76.0 | 1.56 |
| >0.7 < 1.5 | 2.5 | 55.9 | 6.62 |
| >0.3 < 0.76 | 3.4 | 45.6 | 14.9 |
| >0.1 < 0.30 | 3.1 | 33.1 | 5.16 |
| >0.0 < 0.11 | 1.3 | 31.0 | 4.48 |
| >0.0 < 0.05 | 0.8 | 23.6 | 2.44 |

The MagnetoGraph shows the important relationships which exist between ash and sulfur bearing minerals found in this coal and correlates them to the magnetic susceptibility measured in units of $10^{-6}$ cc/gram. For this coal there are ash-forming minerals which can be extracted magnetically which are low in sulfur. As the MagnetoGraph shows, "ash" and weight of magnetics correlate closely over the range of susceptibilities studies. There are two discernable peaks for the ash component. The greater portion of the ash-forming minerals which are separated have magnetic susceptibilities extending from $1\times10^{-6}$ cc/gram up to the $10\times10^{-6}$ cc/gram. A lesser amount of separated material has susceptibilities which are an order of magnitude less. A separator limited to removal of the more magnetic material would not separate sulfur from this coal.

The distribution of sulfur does not correlate with weight of magnetics over the entire range of susceptibilities studies. There is a correlation between sulfur, ash, and weight of magnetics, however, in the lower susceptibility range extending from $01.\times10^{-6}$ cc/gram up to $1\times10^{-6}$ cc/gram. The greatest portion of the magnetically separable sulfur is associated with iron pyrite.

A surprising discovery of this work was the existence of strongly magnetic material in this coal which is low in sulfur. Further, high sulfur material also occurs in this coal which is feebly paramagnetic with an apparent magnetic susceptibility of about $0.3\times10^{-6}$ per gram. This value of the susceptibility corresponds closely to the value of the magnetic susceptibility for coal derived iron pyrite as reported by P. Burgardt and M. S. Seerha, Solid State Communications 22, pp. 153-156 (1977).

It is difficult to make measurements by this method. Usually many passes down the tray, at rates of only a gram per minute, are required using different combinations of field and side slope before the analysis is complete. Further, the method is limited to measurements of magnetic susceptibility greater than about $0.2\times10^{-6}$ cc/gram because of the 20,000 gauss upper limit on the magnetic field produced by the Frantz electromagnet and because of difficulties in making mechanical separations of the sliding particles at low side slope angles. The natural tendency of particles to spread across the tray destroys the selectivity of the magnetic method when side slope angles less than 1 degree are used. Measurements on particles of susceptibility less than $0.2\times10^{-6}$ cc/gram and which are smaller than 74 to 100 microns mean particle diameter are difficult by this method.

Characteristics of the clean coal prepared from the Upper Freeport seam raw coal by magnetic separation are given in Table II. These results illustrate several important observations about magnetic beneficiation of this coal.

First, starting with coal of 22.3% ash and 1.86% sulfur, a clean coal of 7.6% ash and 1.08% sulfur was prepared with a weight recovery of 73.5% for this fraction. This corresponds to a calculated "combustible yield" of 88.4%. Thus, efficient separations can be achieved with use of a magnetic method.

Secondly, to achieve desulfurization of this coal, one must separate feebly magnetic particulates. Separation of material down to a susceptibility of $10^{-6}$ cc/gram is not sufficient. A separation of this type actually increases % sulfur in the product because the pyrites are not removed. The technical conditions necessary to desulfurize the coal are explicitly given by the MagnetoGraphic measurement.

TABLE II

CHARACTERISTICS OF 30 × 50 MESH CLEAN COAL PREPARED BY DRY MAGNETIC SEPARATION OF UPPER FREEPORT SEAM RAW COAL, ARMSTRONG COUNTY, PENNSYLVANIA

| Apparent Magnetic Susceptibility $10^{-6}$ per gram Dry Basis | Weight Recovery Wt. %, Dry Basis | Ash Wt. %, Dry Basis | Sulfur Wt. %, |
|---|---|---|---|
| >20 | 99.6 | | |
| >9.7 < 20 | 99.3 | | |
| >6.1 < 9.7 | 98.5 | 22.3 | 1.87 |
| >3.9 < 6.1 | 93.6 | 18.8 | 1.93 |
| >2.6 < 3.9 | 89.1 | 15.3 | 1.99 |

TABLE II-continued

CHARACTERISTICS OF 30 × 50 MESH CLEAN COAL PREPARED BY DRY MAGNETIC SEPARATION OF UPPER FREEPORT SEAM RAW COAL, ARMSTRONG COUNTY, PENNSYLVANIA

| Apparent Magnetic Susceptibility $10^{-6}$ per gram Dry Basis | Weight Recovery Wt. %, Dry Basis | Ash Wt. %, Dry Basis | Sulfur Wt. %, |
|---|---|---|---|
| >1.5 < 2.6 | 84.6 | 12.0 | 2.02 |
| >0.76 < 1.5 | 82.1 | 10.7 | 1.88 |
| >0.30 < 0.76 | 78.7 | 9.2 | 1.31 |
| >0.11 < 0.30 | 75.6 | 8.2 | 1.15 |
| >0.05 < 0.11 | 74.3 | 7.8 | 1.09 |
| >0.01 < 0.05 | 73.5 | 7.6 | 1.08 |

As the elements of Table II show, it is possible to reduce the ash of the coal from 22% to 12% with removal of only moderately magnetic material. This is possible with use of innovative neodymium-boron-iron rare earth permanent magnets. See B. K. Parekh, et al., "Dry Coal Cleaning Using a Rare Earth Magnetic Separator," Proceedings of the Fourth Annual Pittsburgh Coal Conference, hosted by the University of Pittsburgh School of Engineering, Pittsburgh, Pa. (1987), pp. 877–883. Unfortunately, however, the permanent magnet technology is not able to magnetize large volumes with the high energy gradient fields necessary to separate feebly magnetic sulfur-bearing material such as iron pyrite. The result of separation with inadequate magnets is an actual concentration of the sulfur in the clean coal product as can be seen in Table II and in the results presented by Parekh, et al.

One of the major unexpected results of this work was the discovery that natural iron pyrite in coal is feebly magnetic and that it can be separated from coal efficiently with use of dry continuously operating magnetic separation methods if steps are taken to first remove the interference of more strongly magnetic nonsulfur bearing minerals and if magnetic fields with sufficiently high energy gradient are employed. In a process directed at separation of relatively strongly magnetic material, the feebly paramagnetic iron pyrite will simply move with the diamagnetic coal and no separation of pyrite will be affected as was observed to be the case with use of the permanent magnet technology. This is illustrated in the elements of Table I and FIG. 1 where it can be seen that the sulfurous and ash forming contaminants in the Upper Freeport coal are of significantly differing magnetic susceptibilities and that the sulfur concentration actually increases when the separation is limited to removal of material of magnetic susceptibility grater than approximately $3\times10^{-6}$ cc/gm.

The practical significance of this discovery is illustrated in the results of measurements obtained in a two pass magnetic beneficiation of five different coals from Pennsylvania. Characteristics of the raw coals are given in Table III. The separations were obtained in processing 30×325 mesh fractions of these coals through an 8-inch length with a region of magnetic energy gradient up to 100 million Gauss²/cm.

TABLE III

CHARACTERISTICS OF FIVE RAW COALS FROM PENNSYLVANIA

| Coal | Origin | Ash (Wt. %) | Sulfur (Wt. %) |
|---|---|---|---|
| Lower Kittanning | Clearfield County | 17.94 | 4.21 |

TABLE III-continued

CHARACTERISTICS OF FIVE RAW COALS FROM PENNSYLVANIA

| Coal | Origin | Ash (Wt. %) | Sulfur (Wt. %) |
|---|---|---|---|
| Upper Freeport | Armstrong County | 23.82 | 1.64 |
| Pittsburgh | Greene County | 25.30 | 1.90 |
| Lower Freeport | Indiana County | 25.97 | 1.41 |
| Pittsburgh | Washington County | 25.39 | 1.32 |

Results of the measurements are given in Table IV and are illustrated in FIGS. *6a* and *6b*. The number at the top of each bar graph in the figures represents the magnetic susceptibility (in units of $10^{-6}$ cc/gm) at which the separation was made. The first pass separations were carried out so as to remove particles of magnetic susceptibility greater than 1 to $3\times10^{-6}$ cc/gm while the second pass separations were carried out so as to remove particles of magnetic susceptibility in the range 0.1 to $0.3\times10^{-6}$ cc/gm. A magnetic energy gradient of typically 34 million Gauss²/cm was employed for the first pass separation and an energy gradient of 100 million Gauss²/cm was used for the second pass.

TABLE I

Rough MagnetoGraphs 30 × 325 Mesh Fractions of 5 Raw Coals of Southwestern Pennsylvania

| Ash, % | Sulfur, % | Mag. Susc.[1] | Weight Rec. % | Ash Rej. % | Sulfur Rej. % | Combust. Yld. %[2] |
|---|---|---|---|---|---|---|
| Lower Kittanning, Clearfield | | | | | | |
| Magnetic Isolates | | | | | | |
| 12.7 | 3.1 | 0.7 | 91.5 | 29.2 | 26.4 | 97.4 |
| 9.4 | 2.2 | 0.1 | 84.1 | 47.6 | 47.7 | 92.9 |
| Upper Freeport, Armstrong | | | | | | |
| Magnetic Isolates | | | | | | |
| 15.2 | 1.6 | 2.2 | 87.4 | 36.2 | 2.4 | 97.3 |
| 9.3 | 1.3 | 0.3 | 75.5 | 64.0 | 33.0 | 90.2 |
| Pittsburgh, Greene | | | | | | |
| Magnetic Isolate s | | | | | | |
| 16.3 | 2.0 | 1.5 | 87.6 | 35.6 | −5.3 | 98.2 |
| 10.3 | 1.7 | 0.1 | 76.4 | 59.3 | 10.5 | 91.7 |
| Lower Freeport, Indiana | | | | | | |
| Magnetic Isolates | | | | | | |
| 20.4 | 1.60 | 1.7 | 90.1 | 21.4 | −13.5 | 96.8 |
| 10.0 | 1.30 | 0.1 | 69.3 | 61.5 | 7.8 | 84.3 |
| Pittsburgh, Washington | | | | | | |
| Magnetic Isolates | | | | | | |
| 20.2 | 1.4 | 1.0 | 90.2 | 20.4 | −6.1 | 96.5 |
| 7.1 | 1.3 | 0.5 | 73.7 | 72.0 | 1.5 | 91.7 |

[1]Average value for all screen sizes, ($10^{-6}$ cc/gm).
[2]Calculated.

Ash reduction is achieved in both the first and second pass for each of the five coals. Sulfur reduction is achieved in the first pass for only the Lower Kittanning seam coal and to a small extent for the Upper Freeport seam coal. Sulfur is actually increased after the first pass for the Pittsburgh and Lower Freeport seam coals. All cases showed sulfur reduction after two passes. The example illustrates the fact that efficient separation of feebly paramagnetic minerals from feebly diamagnetic coal is possible if the strongly paramagnetic minerals are removed in a separate first pass separation and if separators producing sufficiently large magnetic energy gradients employed.

Figure 7:
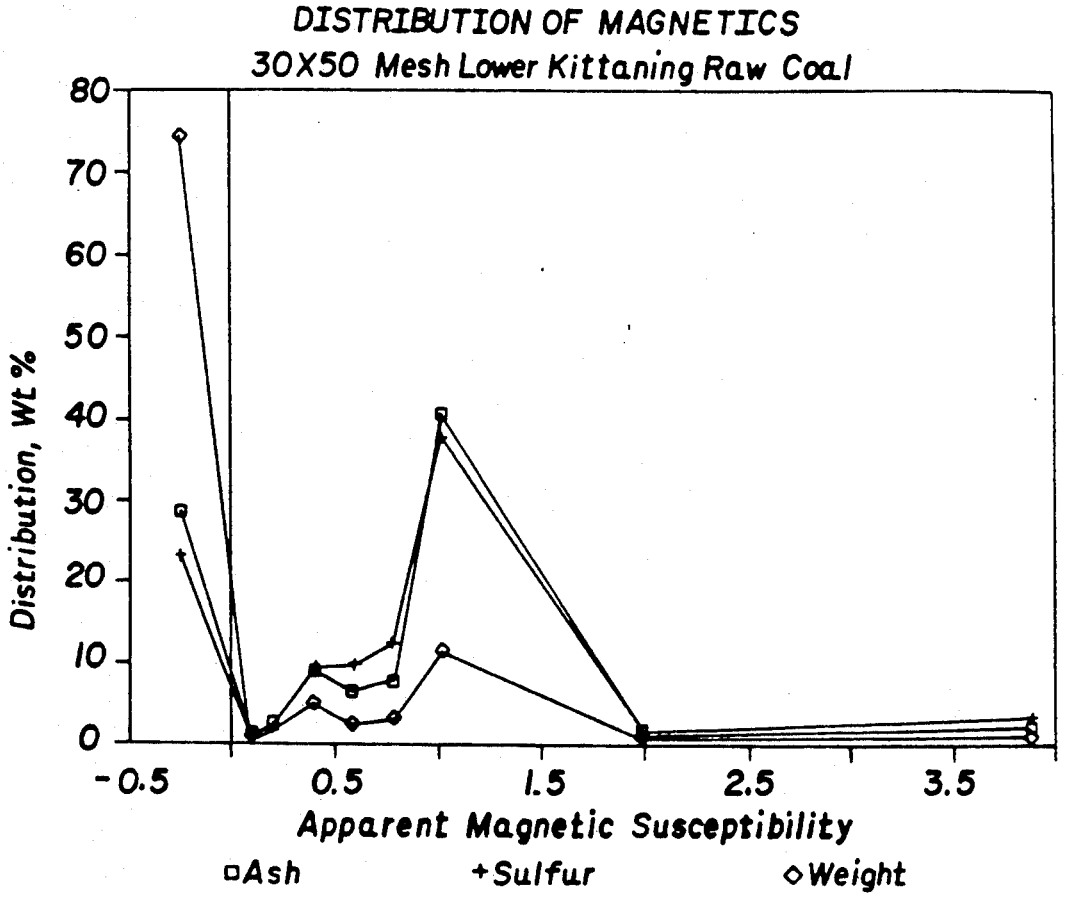
FIG. 7 illustrates a MagnetoGraph of a 30×50 Mesh Fraction From Lower Kittanning Seam Raw Coal.

Not all coals behave the same in respect to beneficiation by magnetic methods and MagnetoGraphs are essential in understanding and recognizing these differences. This is illustrated in FIG. 7 which shows the MagnetoGraph of the Lower Kittanning coal from Clearfield County in Pennsylvania. The sulfur peak associated with iron-pyrite is relatively small. In this coal, the sulfate concentration is greater than that observed for the Upper Freeport and the sulfur correlates closely with other ash forming minerals. This correlation is clearly illustrated in the MagnetoGraph of FIG. 7. For this coal, in strong contrast to the Upper Freeport seam coal, ash and sulfur correlate closely and sulfur is removed in mineral fractions which exhibit large values of the magnetic susceptibility.

Another unexpected result of the present invention is the discovery that coal beneficiation by diamagnetic separations are possible. We have discovered that the diamagnetic components of coal remaining after separation of paramagnetic mineral matter have varying degrees of ash and sulfur and that the coal components with these ash and sulfur levels exhibit different levels of diamagnetic susceptibility. This shows that diamagnetic mineral matter can be separated from the hydrocarbon structure of coal by magnetic methods.

This is illustrated in the elements of Table V which relate ash, sulfur and weight recovery to the magnetic susceptibility of a 16×30 mesh fraction taken from the Lower Kittanning Seam coal from Clearfield County, Pa. This fraction was characterized by an ash level of 12.63 Wt. % and a sulfur level of 5.45 Wt. %.

TABLE V

MagnetoGraph Data for 16 × 30 Mesh Fraction of Lower Kittanning Seam coal from Clearfield County, Pennsylvania

| Magnetic Susceptibility ($10^{-6}$ cc/gm) | Recovery Wt. % | Ash Wt. % | Sulfur Wt. % | CUMULATIVE → Recovery Wt. % | Ash Wt. % | Sulfur Wt. % |
|---|---|---|---|---|---|---|
| > −1.50 | 3.58 | 6.37 | 2.14 | 3.58 | 6.37 | 2.14 |
| > −1.25 < −1.50 | 1.26 | 7.52 | 2.55 | 4.84 | 6.67 | 2.25 |
| > −1.00 < −1.25 | 3.43 | 5.49 | 1.96 | 8.27 | 6.18 | 2.13 |
| > −0.75 < −1.00 | 3.48 | 5.51 | 1.94 | 11.75 | 5.98 | 2.07 |
| > −0.50 < −0.75 | 10.07 | 5.05 | 1.83 | 21.82 | 5.55 | 1.96 |
| > −0.25 < −0.50 | 32.31 | 5.86 | 1.99 | 54.13 | 5.74 | 1.98 |
| > −0.15 < −0.25 | 16.65 | 8.03 | 2.80 | 70.78 | 6.28 | 2.17 |
| > −0.15 < +0.15 | 8.16 | 13.55 | 4.48 | 78.94 | 7.03 | 2.41 |
| > +0.15 < +0.25 | 2.33 | 16.71 | 6.52 | 81.27 | 7.31 | 2.53 |
| > +0.25 < +0.50 | 7.53 | 14.04 | 5.72 | 88.80 | 7.88 | 2.80 |
| > +0.50 < +0.75 | 0.86 | 35.64 | 19.05 | 89.66 | 8.15 | 2.96 |
| > +0.75 < +1.00 | 0.86 | 37.15 | 19.61 | 90.52 | 8.43 | 3.12 |
| > +1.00 < +1.50 | 4.45 | 40.68 | 24.38 | 94.97 | 9.94 | 4.12 |
| > +1.50 < +2.00 | 1.09 | 59.47 | 29.30 | 96.06 | 10.50 | 4.41 |
| > +2.00 < +2.50 | 1.51 | 68.52 | 24.86 | 97.57 | 11.40 | 4.73 |
| > +2.50 < +3.00 | 1.04 | 68.81 | 25.48 | 98.61 | 12.01 | 4.95 |
| > +3.00 < + | 1.39 | 56.57 | 41.28 | 100.00 | 12.63 | 5.45 |

It is apparent from Table V that the coal of lowest ash and sulfur levels is obtained for coal in the fractions with values between −0.50 and −0.75 of the diamagnetic susceptibility. Evidently the ash and sulfur levels observed for this coal are associated with the diamagnetic mineral matter in the coal and with the coal itself. The ash and sulfur levels of paramagnetic fractions are significantly greater than those of the diamagnetic fractions.

Beginning with a 16×30 mesh fraction of a feed coal of 12.63 wt. % ash, significant recoveries of 5% to 6% ash coal can be obtained. Further, beginning with a similar feed coal of 5.45% sulfur, significant recoveries of 2.0% sulfur coal can be obtained.

In another example, the adverse effects of performing multiple magnetic separations of weakly magnetic material in a sequence other than that specified by the preferred method of this invention are illustrated in a comparison of the results of two different approaches to making magnetic separations employing the tray arrangement for a 30×50 mesh fraction of Lower Kittanning seam coal.

In the first approach, the coal was processed according to a preferred method of this invention. In this method the most magnetic material is first extracted and the less magnetic material remaining is then separated into a more magnetic and a less magnetic fraction. This sequence is repeated until no paramagnetic material remain. This type of sequence is then repeated for the diamagnetic material until no material remains. The results of that test are given in Table VI.

TABLE VI

MAGNETOGRAPH OF 30 × 50 MESH FRACTION OF LOWER KITTANNING SEAM COAL PREPARED BY SEPARATION OF MOST MAGNETIC MATERIAL FIRST

| Magnetic Susceptibility ($10^{-6}$ cc/gm) | Rec. Wt. % | Ash Wt. % | Sulfur Wt. % | ← Cumulative → Rec. Wt. % | Ash Wt. % | sulfur Wt. % | ← Reduction Ash Wt. % | Sulfur Wt. % |
|---|---|---|---|---|---|---|---|---|
| > −0.75 | 1.78 | 5.64 | 2.05 | 1.78 | 5.64 | 2.05 | 50.92 | 58.82 |
| > −0.50 < −0.75 | 6.19 | 4.48 | 1.74 | 7.97 | 4.75 | 1.81 | 58.76 | 63.65 |
| > −0.25 < −0.50 | 40.06 | 4.65 | 1.97 | 48.03 | 4.66 | 1.94 | 59.41 | 60.98 |
| > −0.15 < −0.25 | 36.38 | 7.85 | 2.98 | 84.41 | 6.03 | 2.39 | 47.46 | 51.98 |
| > −0.15 < +0.15 | 6.27 | 21.58 | 8.92 | 90.68 | 7.11 | 2.84 | 38.11 | 42.91 |
| > +0.15 < +0.25 | 0.39 | 41.61 | 23.67* | 91.07 | 7.26 | 2.93 | 36.82 | 41.12 |
| > +0.25 < +0.50 | 1.77 | 36.95 | 21.93 | 92.84 | 7.83 | 3.29 | 31.90 | 33.84 |
| > +0.50 < +0.75 | 2.25 | 47.25 | 30.62 | 95.09 | 8.76 | 3.94 | 23.78 | 20.85 |
| > +0.75 < +1.00 | 0.37 | 52.60 | 30.75* | 95.46 | 8.93 | 4.04 | 22.30 | 18.77 |
| > +1.00 < +1.50 | 2.45 | 59.87 | 32.70 | 97.91 | 10.20 | 4.76 | 11.21 | 4.36 |
| > +1.50 < +2.00 | 0.67 | 70.95 | 19.61 | 98.58 | 10.62 | 4.86 | 7.61 | 2.33 |
| > +2.00 < +2.50 | 0.85 | 74.68 | 7.28 | 99.43 | 11.16 | 4.88 | 2.85 | 1.92 |
| > +2.50 < +3.00 | 0.34 | 71.37 | 15.29* | 99.77 | 11.37 | 4.92 | 1.06 | 1.20 |
| > +3.00 | 0.24 | 62.20 | 29.91* | 100.01 | 11.49 | 4.98 | 0.00 | 0.00 |

The sulfur values marked by * have been extrapolated. These components were not analyzed because of insufficient amount of material.

The lowest ash and sulfur coal component was observed to occur in the $-0.5\times10^{-6}$ cc/gm to $-0.75\times10^{-6}$ cc/gm susceptibility range. Using the method of the invention, beginning with 30×50 mesh Lower Kittanning coal of 11.49% ash and 4.98% sulfur, a 4.66% ash and 1.94% sulfur product could be prepared with 48.03% weight recovery. This corresponds to an ash reduction of 59.41% and a sulfur reduction of 60.98%.

In the second approach, the 30×50 mesh Lower Kittanning coal was first split into paramagnetic and diamagnetic fractions using the tray arrangement of the Frantz Isodynamic Separator. Next, the paramagnetic fraction was separated into components of differing magnetic susceptibility beginning with the least magnetic and proceeding to the most magnetic. Lastly, the diamagnetic fraction was separated into components of differing diamagnetic susceptibilities beginning with the least diamagnetic and proceeding to the most diamagnetic. The results of that test are given in Table VII.

TABLE VII

MAGNETOGRAPH OF 30 × 50 MESH FRACTION OF LOWER KITTANNING SEAM COAL PREPARED BY ALTERNATIVE SEPARATION SEQUENCE

| Magnetic Susceptibility ($10^{-6}$ cc/gm) | Rec. Wt. % | Ash Wt. % | Sulfur Wt. % | ← Cumulative → Rec. Wt. % | Ash Wt. % | Sulfur Wt. % | ← Reduction → Ash Wt. % | Sulfur Wt. % |
|---|---|---|---|---|---|---|---|---|
| > −0.75 | 0.19 | 5.86 | 1.35 | 0.19 | 5.86 | 1.35 | 46.18 | 71.39 |
| > −0.50 < −0.75 | 2.85 | 5.07 | 1.82 | 3.04 | 5.12 | 1.79 | 52.98 | 62.05 |
| > −0.25 < −0.50 | 15.92 | 5.07 | 1.79 | 18.96 | 5.08 | 1.79 | 53.36 | 62.06 |
| > −0.15 < −0.25 | 31.88 | 6.07 | 2.11 | 50.84 | 5.70 | 1.99 | 47.64 | 57.81 |
| > −0.15 < +0.15 | 35.08 | 7.91 | 2.81 | 85.92 | 6.60 | 2.33 | 39.36 | 50.72 |
| > +0.15 < +0.25 | 0.37 | 14.69 | 6.03 | 986.30 | 6.64 | 2.34 | 39.04 | 50.38 |
| > +0.25 < +0.50 | 1.11 | 17.93 | 7.73 | 87.41 | 6.78 | 2.41 | 37.71 | 48.93 |
| > +0.50 < +0.75 | 1.07 | 21.07 | 8.89 | 88.48 | 6.95 | 2.49 | 36.13 | 47.27 |
| > +0.75 < +1.00 | 0.93 | 24.05 | 11.47 | 89.41 | 7.13 | 2.58 | 34.49 | 45.29 |
| > +1.00 < +1.50 | 1.86 | 30.52 | 15.53 | 91.27 | 7.61 | 2.85 | 30.13 | 39.71 |
| > +1.50 < +2.00 | 1.66 | 38.62 | 18.21 | 92.93 | 8.16 | 3.12 | 25.03 | 33.89 |
| > +2.00 < +2.50 | 1.34 | 45.47 | 21.22 | 94.26 | 8.69 | 3.38 | 20.18 | 28.45 |
| > +2.50 < +3.00 | 1.57 | 51.00 | 22.84 | 95.83 | 9.38 | 3.69 | 13.82 | 21.70 |
| > +3.00 | 4.17 | 45.47 | 28.26 | 100.00 | 10.89 | 4.72 | 0.00 | 0.00 |

The lowest ash and sulfur coal component was observed to occur in the $-0.25\times10^{-6}$ cc/gm to $-0.5\times10^{-6}$ cc/gm susceptibility range. Using the alternative method, beginning with 30×50 mesh Lower Kittanning coal of 10.89% ash and 4.72% sulfur, by interpolation, a 5.65% ash and 1.97% sulfur product could be prepared with 48.03% weight recovery. This corresponds to an ash reduction of 48.12% and a sulfur reduction of 58.26%.

The method of a preferred embodiment of the present invention prepared the lowest ash and sulfur product at the stated recovery and achieved the highest ash and sulfur rejections. While the reasons for this noncommutativity are not fully understood at this time, the result of the different approaches is apparent in the higher ash and sulfur levels of the magnetic extracts separated by the method of this invention (See Table VI above). When the first separation is made under conditions corresponding to separation of weakly magnetic material, there is a tendency to create a large amount of misplaced material in the paramagnetic fraction when using the tray arrangement of the Frantz Isodynamic Separator. This has the effect of lowering the recovery of the diamagnetic component and of lowering the ash and sulfur values of the paramagnetic isolates.

LUNAR SAMPLES

In another series of experiments, the MagnetoGraph method was applied to a magnetic characterization of a lunar soil sample. Several unanticipated results were realized in this work when it was discovered that the magnetic characteristic of the lunar soil was distinctly different from that of terrestrial mineral analogs or of terrestrial simulants of the lunar soil sample. While many magnetic measurements of a scientific nature have been made using lunar soil samples, none have been applied to characterization of the resource for practical recovery of mineral components and none has discovered the effects reported here.

First, we have developed a means whereby relatively pure anorthite (calcium-aluminum silicate) can be recovered from mature lunar soil by magnetic separation. The magnetism of the lunar anorthite is similar to that of anorthite recovered from a terrestrial ore from Minnesota but the terrestrial ore bearing rock, anorthosite, has a magnetic characteristic which is distinctly different from that of the lunar soil because of the absence of agglutinates in the terrestrial rock sample. The lunar soil sample was nominally 100 microns mean particle diameter.

Secondly, we developed a means for the recovery of agglutinates from the lunar sample. There are no agglutinates in natural or man-made terrestrial materials. Because of the presence of the agglutinates and their included free iron, the resulting MagnetoGraph of the lunar sample bore no resemblance to that of either the anorthosite from Minnesota or that of a lunar simulant prepared from Minnesota basaltic sill (Paul W. Weiblen and Katherine L. Gordon, "Characteristics of a Simulant for Lunar Surface Materials," Paper No. LBS-88-213, presented at Lunar Bases & Space Activities in the 21st Century, Houston, Tex. April 5-7, 1988).

As will be seen in the following examples, this discovery is of great significance to magnetic beneficiation of lunar soil. The separator which would be specified for the lunar soil application is significantly different than either of those specified on the basis of processing lunar soil analogs or simulants.

LUNAR HIGHLANDS SOIL NO. 64421

Approximately one gram of Apollo 16 lunar soil sample 64421 was screened into three screen fractions shown in Table VIII.

TABLE VIII

Screen Fractions and Weight Distribution of Magnetics for Lunar Soil Sample 64421

| Screen Fraction (Microns) | Weight (Grams) | Recovery (Wt. %) |
|---|---|---|
| +150 | 0.4634 | 41.1 |

TABLE VIII-continued

Screen Fractions and Weight Distribution of Magnetics for Lunar Soil Sample 64421

| Screen Fraction (Microns) | Weight (Grams) | Recovery (Wt. %) |
|---|---|---|
| 44 × 150 | 0.3079 | 27.3 |
| −44 | 0.3572 | 31.7 |
| | 1.1285 | |

MagnetoGraphs were developed for the +150 micron and the 44×150 micron fractions of the sample. The magnetic fractions were subjected to a petrographic evaluation to determine the relationship of the major soil and rock components separated to their magnetic susceptibilities. The MagnetoGraph data are shown in Tables IX and XI and the petrographic evaluations are given in Tables X and XII.

TABLE IX

Distribution of Magnetics for +150 Micron Fraction of Lunar Soil No. 64421

| Magnetic Susceptibility Range ($10^{-6}$ cc/gm) | Weight (Grams) | Wt. Rec. +150 Micron Fraction (Wt. %) | Concentration Ano. % | Concentration Agl. % | Distribution Ano. % | Distribution Agl. % |
|---|---|---|---|---|---|---|
| < 0.75 | 0.0574 | 12.7 | 95.0 | 0.0 | 40.9 | 0.0 |
| >0.75 < 5.58 | 0.1109 | 24.6 | 70.0 | 5.0 | 58.3 | 8.5 |
| >5.58 < 64.9 | 0.2194 | 48.6 | 20.0* | 10.0 | 0.0 | 33.5 |
| >64.9 < 699 | 0.0562 | 12.5 | 1.7 | 55.0 | 0.7 | 47.3 |
| >699 < 7470 | 0.0078 | 1.7 | 1.0 | 95.0 | 0.1 | 10.7 |
| >7470 | 0.0003 | | | | | |
| | 0.4520 | | | | | |

*Estimated
Ano. = Anorthite
Agl. = Agglutinates

Figure 8:
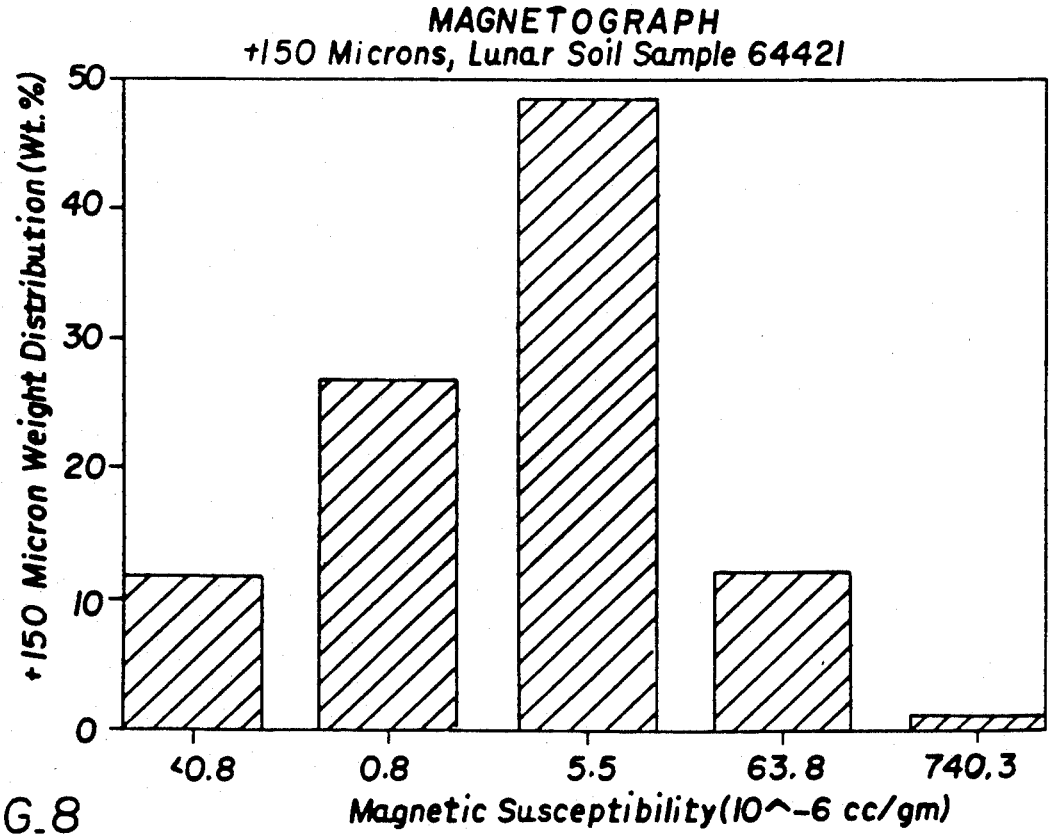
FIG. 8 illustrates a MagnetoGraph of a Lunar Soil sample.

The work indicates an interesting magnetic spectrum for this material. This is illustrated in FIG. 8. First, there is no ferromagnetic material as was expected based on the presence of agglutinates containing strongly magnetic iron. Evidently the overall strong magnetism of the very fine sized iron inclusions is diluted by the inert glassy component of the agglutinate. Secondly, the peak in the paramagnetic component occurs at a relatively low value of the magnetic susceptibility of the order of $5.5\times10^{-6}$ cc/gm. Thirdly, the measurements indicate a significant amount of weakly magnetic material including some diamagnetic material in the lunar sample.

MODAL ANALYSIS

The magnetic fractions were evaluated petrographically to determine the mode of occurrence of the major soil and rock types observed. The results of that analysis are given in Table X.

TABLE X

Modal Analysis of Magnetic Separates of Lunar Soil 64421 +100 Mesh (>150 microns)

| Magnetic Susceptibility Range ($10^{-6}$ cc/gm) | Description |
|---|---|
| < 0.75 | >95% Anorthite grains (both clear and sugary); <5% impurities consisting of small (100–200 um) dark glass and mineral (ol/px) fragments + a few microbreccia grains; no agglutinates. |
| >0.75 < 5.58 | 40% large (0.4–0.6 mm) rocks (¾ = Anorthosite; ¼ microbreccias + dark-colored rocklets); 55% finer (150–300 um) grains (¾ = anorthite + anorthosite; ¼ = glass, dark mineral fragments (ol/px)); <5% agglutinates; this separate consists of about 70% anorthite. |
| >5.58 < 64.9 | Coarsest of all separates; 40% large (0.4–1 mm) mostly dark rock fragments (coarse anorthosite + microbreccias; ¼ = clean anorthosites); 30% finer (150–200 um) rock and mineral fragments (¼ = anorthosite + anorthite; remainder = microbreccias + ol/px + dark [impure] anorthosite pieces); 10% glass beads and glassy particles; 10% 200–300 um anorthite; 10% agglutinates. |

ol = Olivine
px = plyroxene

Figure 9:
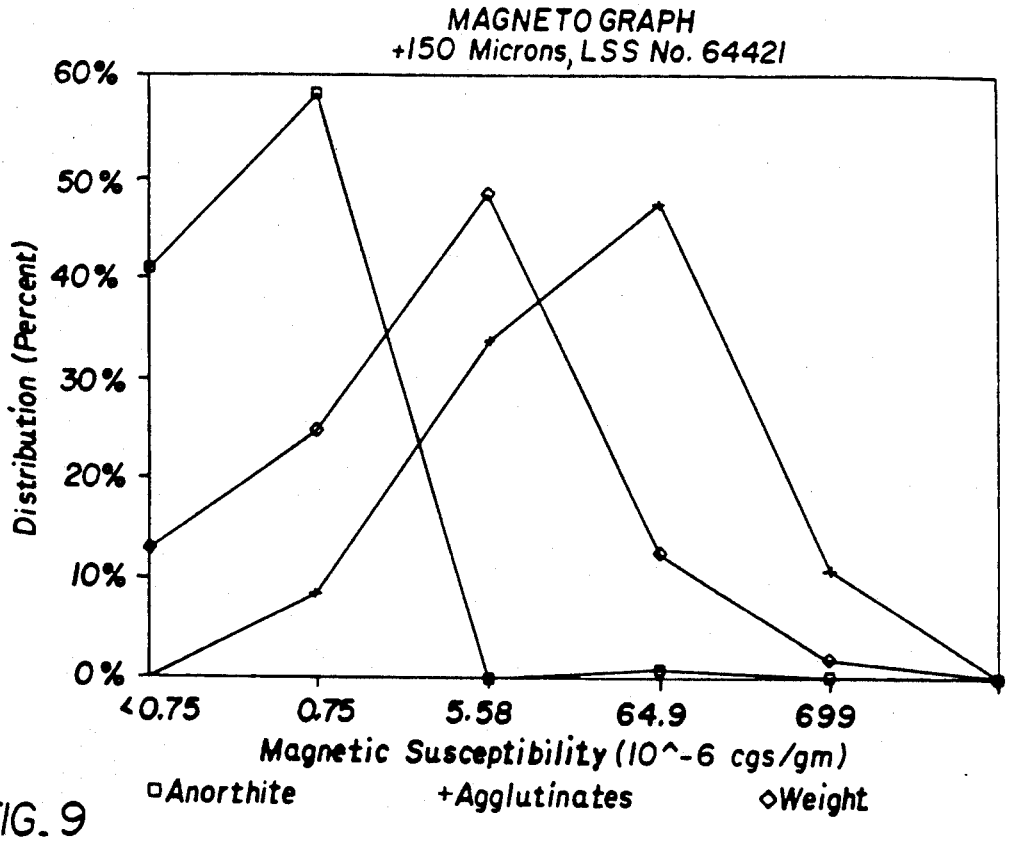
FIG. 9 illustrates an Anorthite/Agglutinate MagnetoGraph for a Lunar Soil sample.

FIG. 9 illustrates the Anorthite/Agglutinate MagnetoGraph for the +150 micron size fraction which has been prepared by combining the magnetic and the petrographic information. The data, never before observed, indicate the different cut points at which effective separation of anorthite and agglutinates could be achieved for this material. For example, the distribution of anorthite peaks in the components with magnetic susceptibility less than $5.5\times10^{-6}$ cc/gm while the distribution of agglutinates peaks in the components with magnetic susceptibility greater than this value. A separation at a magnetic susceptibility about $0.8\times10^{-6}$ cc/gm would recover about 40% of the anorthite at 95% concentration while rejecting the greater portion of the agglutinates.

FINE FRACTION

The distribution of weight, anorthite, and agglutinates for the 44×150 micron size fraction are given in Table XI. The data indicate that the magnetic method of the present invention works well for lunar particles in the +44 micron size range.

TABLE XI

Distribution of Magnetics for 44 × 150 Micron Fraction of Lunar Soil No. 64421

| Magnetic Susceptibility Range ($10^{-6}$ cc/gm) | Weight (Grams) | Wt. Rec. +150 Micron Fraction (Wt. %) | Concentration Ano. % | Concentration Agl. % | Distribution Ano. % | Distribution Agl. % |
|---|---|---|---|---|---|---|
| < 0.75 | 0.0345 | 12.6 | 85.0 | 5.0 | 31.4 | 1.4 |
| >0.75 < 5.58 | 0.0480 | 17.5 | 65.0 | 10.0 | 33.4 | 4.0 |
| >5.58 < 64.9 | 0.0965 | 35.2 | 30.0 | 45.0 | 31.0 | 35.9 |
| >64.9 < 699 | 0.0772 | 28.2 | 5.0 | 70.0 | 4.1 | 44.7 |
| >699 < 7470 | 0.0179 | 6.5 | 0.0 | 95.0 | 0.0 | 14.1 |
| | 0.2741 | | | | | |

Ano. = Anorthite
Agl. = Agglutinates

The Anorthite/Agglutinate MagnetoGraph for the 44×150 mesh fraction is similar to that of the coarse fraction except that the distributions are somewhat broader.

Figure 10:
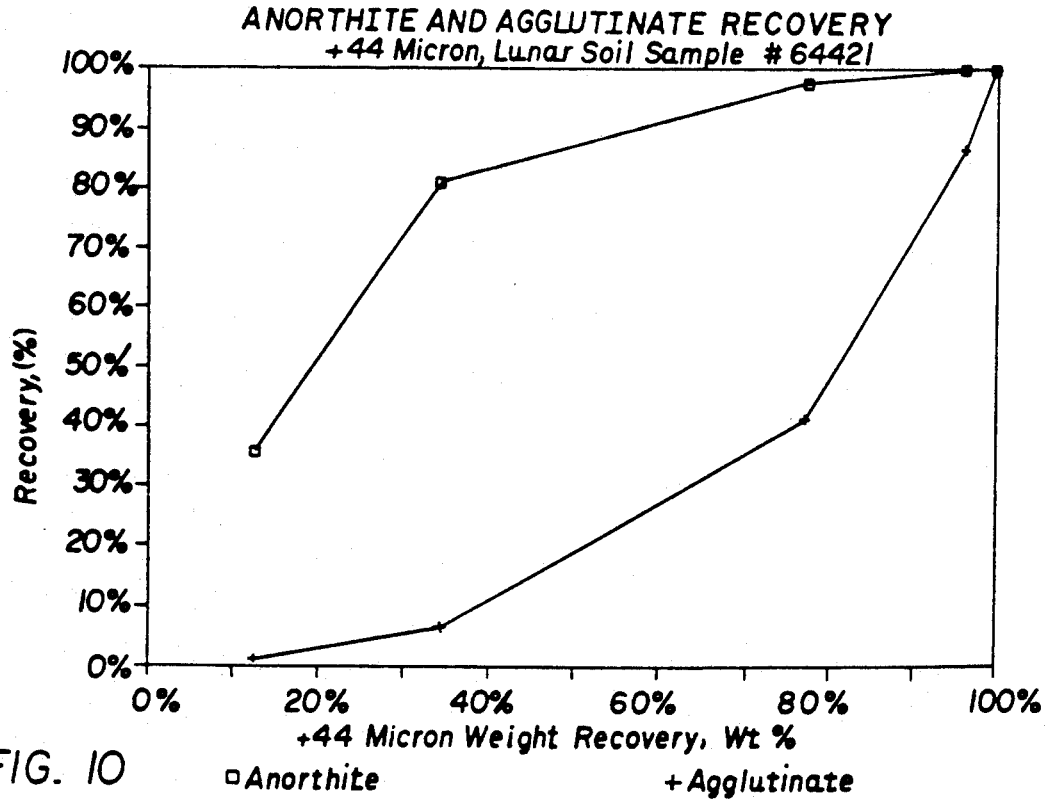
FIG. 10 illustrates recovery of Anorthite and Agglutinates achieved according to the present invention.

FIG. 10 shows the recovery of Anorthite and Agglutinates in the +44 micron size fraction that could be achieved by the magnetic method. This is a further illustration of the type of information that can be developed by the MagnetoGraph method. In this example, the diamagnetic fraction would serve as a source of low-iron-concentration anorthite for use in extraction of oxygen, calcium, aluminum, and silicon while the paramagnetic fractions would serve as a source of agglutinates for recovery of free iron and other materials of a glassy nature.

TABLE XII

Modal Analysis of Magnetic Separates of Lunar Soil 64421 <100 > 325 Mesh (< 150 > 44 microns)

| Magnetic Susceptibility Range ($10^{-6}$ cc/gm) | Description |
|---|---|
| < 0.75 | 85% anorthite xls (clear & sugary); 5% agglutinates & glasses (50-75 um); 5% rock fragments (75-150 um); 5% ol/px xls crystals (45-65 um). |
| >0.75 < 5.58 | 65% anorthite xls (45-75 um); 10% agglutinates + glasses; 15% rock fragments; 10% ol/px crystals; finest particles are >90% anorthite crystals. |
| >5.58 < 64.9 | 30% anorthite crystals (<60 um); 45% agglutinates + glass (50-75 um); 20% rock fragments; 5% ol/px crystals. |
| >64.9 < 699 | 70% agglutinates + glasses (50-75 um); 20% rock fragments; 5% ol/px crystals; 5% anorthite; this separate is 75-80% of the size range 50-75 um. |
| >699 | 95% agglutinates + glass (50-85 um); 5% rock and min fragments. |

ol = Olivine
px = plyroxene

There have been a number of processes proposed for lunar manufacture of materials. Some of these are itemized in Table XIII. References to the individual processes have been compiled by W. C. Cochran, "Suggested Processes to Utilize Lunar Resources," appearing in EMEC Consultants Project Workshop, Dry Extraction of Silicon and Aluminum from Lunar Ores, NAS 9-17811, 9-10 Nov., 1987, University of Pittsburgh Applied Research Center, Harmarville, Pa.

TABLE XIII

PROCESSES PROPOSED FOR LUNAR MANUFACTURE OF MATERIALS

| PRODUCTS | PROCESSES |
|---|---|
| H, He, N, | Heating lunar soil to release implanted solar C gases wind gases. |
| Oxygen | Vapor phase pyrolysis of lunar soil |
| Iron | Collection, melting, and casting of native lunar iron |
| Iron | Refining and deposition of native iron by gaseous carbonyl process |
| Iron | Destructive distillation of lunar soil |
| Refractory Oxides, & Slags | iron oxide by solar heating, disproportionation of iron oxide |
| Oxygen | Hydrogen reduction of ilmenite and electrolysis of the water produced |
| Oxygen Steel | Carbothermal reduction of ilmenite and electrolysis Steel of the water produced |
| Magnesium Oxygen | Carbothermal reduction of magnesia |
| Iron Oxygen | Electrolysis of molten silicate rocks |
| Al, Fe, Si, Ti, Mg, Ca | Electrolysis of lunar soil in cryolite flux followed by vacuum fractional distillation |

TABLE XIII-continued

PROCESSES PROPOSED FOR LUNAR MANUFACTURE OF MATERIALS

| PRODUCTS | PROCESSES |
|---|---|
| Si, Al, Oxygen | Reduction of fluxed anorthite with aluminum followed electrolysis |
| Oxide & Fluoro-compounds of Al, Ca, Fe, Mg, Si, & Ti | Fluoroacid (hydrofluoric + fluotitanic acids) leach fluoro- process of lunar soils |
| Oxygen metals | Conversion of lunar soil to plasma and selective ionization for separation. |

Magnetic separation according to the present invention can prepare a feedstock for virtually all of these processes, especially for electrochemical reduction of anorthite to produce aluminum, calcium, silicon, and oxygen. Further, the magnetic separation product will have an advantage for the electrochemical methods in that it is low in iron content.

The free iron found in agglutinates is typically 200 to 300 Angstroms in size so that it will have to be recovered from the agglutinates (typically 80 microns mean diameter) before it can be used. We believe that magnetic concentration of agglutinates will provide an excellent feedstock for thermal and carbonyl size enhancement of free iron in lunar soils. By providing a concentrate, the mass to be treated will be minimized, and the concentration of iron in the reactor will be increased, thus enhancing the possibility for thermal coalescence in the one case and carbonyl uptake of iron in the other. In any event, use of magnetic concentration will lessen the need for treatment of the entire lunar soil, a very costly and inefficient procedure, as is practiced by all of the methods at this time.

It is apparent from Table X and Table XII that the olivine and pyroxene can be recovered in the 0.75 to $5.58\times10^{-6}$ cc/gm fraction of this sample.

There are other minerals and elements of interest which can also be separated from lunar soils by magnetic methods. It has been estimated that the solar wind has implanted about one million tons of Helium-3 in the fine particle fraction of the lunar regolith and that it tends to be concentrated with the mineral ilmenite in lunar mare soils (Cameron, E. N., Wisconsin Report Number, WCSAR-TR-AR3-8708 (1987), incorporated by reference herein.

Current thinking calls for mining about 5 million tons of regolith per year to obtain approximately 2.25 million tons of the minus 50 micron size fraction for thermal processing for Helium-3 recovery (I. N. Sviatoslavsky and M. Jacobs, "Mobile Helium-3 Mining and Extraction System and Its Benefits Toward Lunar Base Self-Sufficiency," Engineering, Construction, and Operations in Space, Proceedings of Space 88, edited by Stewart W. Johnson and John P. Wetzel, Published by the American Society of Civil Engineers, 345 East 47th Street, New York, N.Y. 100172398, pp. 310-321 (August, 1988), incorporated by reference herein in its entirety. It is estimated that this effort will result in 33 kg of Helium-3. One kg of Helium-3 may produce as much as 10 MW-years of electricity on earth when fusion reactors are operational.

Ilmenite is paramagnetic and can be recovered by dry magnetic separation with use of the methods and apparatus of the present invention. Because of this, the method of MagnetoGraphs will be of great utility in establishing the feasibility of magnetic concentration of Helium-3 bearing minerals and rock fragments from the lunar soil and the method and apparatus of the present invention will successfully establish the process for its practical recovery. We believe that use of the methods of this patent can result in a factor of two to five in the amount of material that must be processed for recovery of Helium-3 from lunar regolith. This has the potential for making a significant impact on the potential of this new clean fuel.

It is interesting to note that the average temperature in dark areas out of direct sunlight on the surface of the moon is −171° C. or approximately 100° K. This temperature is within the range of new high temperature superconducting materials such as the yttrium-barium-copper oxides currently under study. Because of this, magnetic separators employing advanced high temperature superconducting magnet windings may find application in magnetic beneficiation of lunar soils.

TERRESTRIAL ANORTHOSITE

A 27 gram sample of anorthosite rock from Carlton Peak, Minn., was screened into six size fractions from 1 mm down to 44 microns. Material from each of the size fractions was magnetically separated into 10 components of magnetic susceptibility ranging from $0.2\times10^{-6}$ cc/gm up to $50\times10^{-6}$ cc/gm in an effort to prepare a terrestrial analog to the lunar anorthite.

Figure 11:
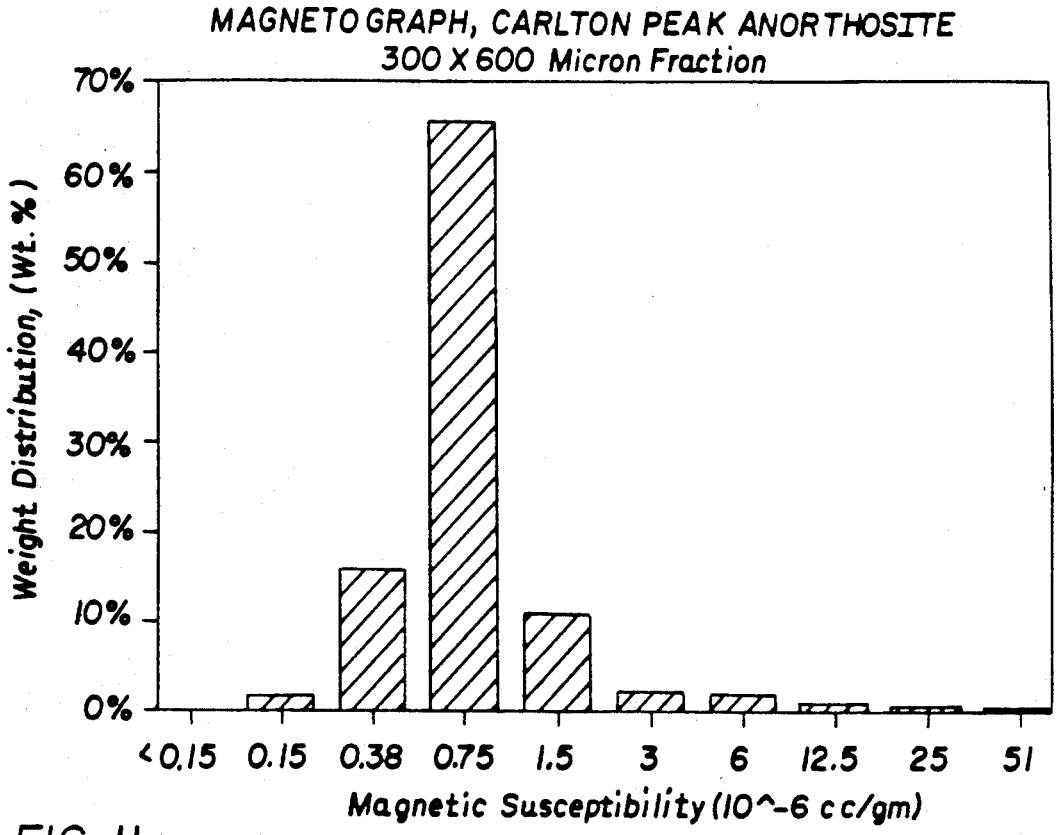
FIG. 11 illustrates a MagnetoGraph of a terrestrial anorthosite sample.
Figure 12:
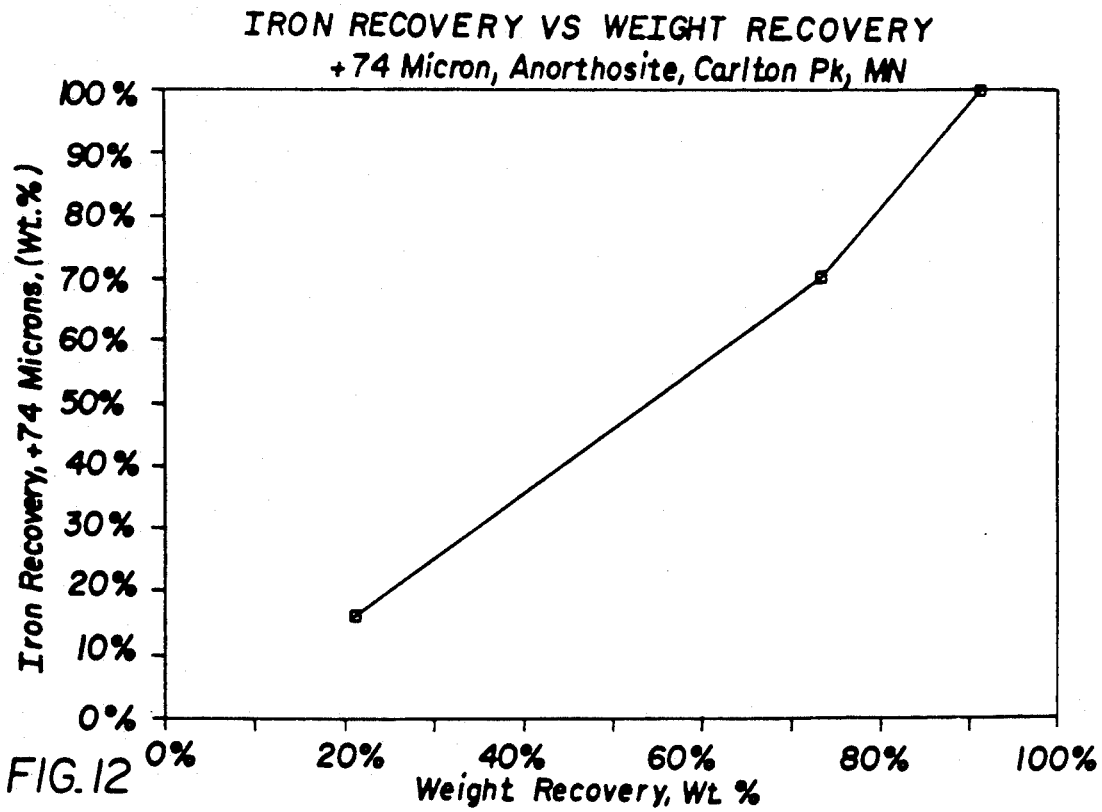
FIG. 12 illustrates iron recovery for the sample of FIG. 11.

The MagnetoGraph of the weight distribution for the 300×600 micron fraction of this sample is illustrated by way of example in FIG. 11. Measurements on 5 size fractions and determinations of iron content in combined samples are given in the following Tables XIV–XVIII. The recovery of iron is illustrated in FIG. 12 for the +74 micron size fraction.

TABLE X

Anorthite from Carlton Peak, Minnesota
16 × 30 Mesh Fraction

| Screen Fraction | Weight (Grams) | Weight Recovery Wt. % |
|---|---|---|
| 16 × 30 | 9.19 | 33.90 |
| 30 × 50 | 7.94 | 29.29 |
| 50 × 100 | 5.11 | 18.85 |
| 100 × 200 | 2.56 | 9.44 |
| 200 × 325 | 1.28 | 4.72 |
| −325 | 1.03 | 3.80 |
| | 27.11 | 100.00 |

16 × 30 Mesh

| Magnetic Susceptibility $10^{-6}$ cgs/gm | Weight Recovery (Grams) | Weight Recovery Wt. % |
|---|---|---|
| < 0.15 | 0.0137 | 0.15 |
| >0.15 < 0.38 | 0.3320 | 3.61 |
| >0.38 < 0.75 | 2.3252 | 25.29 |
| >0.75 < 1.5 | 4.1686 | 45.34 |
| >1.5 < 3 | 1.3911 | 15.13 |
| >3 < 6 | 0.4388 | 4.77 |
| >6 < 12.5 | 0.2796 | 3.04 |
| >12.5 < 25 | 0.1192 | 1.30 |
| >25 < 51 | 0.0928 | 1.01 |
| >51 | 0.3222 | .35 |
| Weight | 9.1932 | 100.00 |
| Starting | 9.1987 | |
| Recovery | 99.9% | |

+16 × 30 Mesh Combined Samples:

| | Weight Grams | Weight Dist. Wt. % | Iron Wt. % | Iron Dist. Wt. % | Cum. Wt. Rec. Wt. % | Iron Wt. % | Iron Rec. Wt. % |
|---|---|---|---|---|---|---|---|
| < 0.75 | 2.6709 | 29.05 | 0.24 | 22.13 | 29.05 | 0.24 | 22.13 |
| >0.75 < 1.5 | 4.1686 | 45.34 | 0.27 | 38.86 | 74.40 | 0.26 | 60.99 |
| >1.5 | 2.3537 | 25.60 | 0.48 | 39.01 | 100.00 | 0.32 | 100.00 |
| Sample Wt. (gm) | 9.1932 | 100.00 | 0.32 | 100.00 | | | |

TABLE XV

Anorthite from Carlton Peak, Minnesota
30 × 50 Mesh Fraction

30 × 50 Mesh

| Magnetic Susceptibility $10^{-6}$ cgs/gm | Weight Recovery (Grams) | Weight Recovery Wt. % |
|---|---|---|
| < 0.15 | 0.0026 | 0.03 |
| >0.15 < 0.38 | 0.1463 | 1.83 |
| >0.38 < 0.75 | 1.2642 | 15.84 |
| >0.75 < 1.5 | 5.2300 | 65.55 |
| >1.5 < 3 | 0.8690 | 10.89 |

TABLE XV-continued

Anorthite from Carlton Peak, Minnesota
30 × 50 Mesh Fraction

| | | |
|---|---|---|
| >3 < 6 | 0.1820 | 2.28 |
| >6 < 12.5 | 0.1647 | 2.06 |
| >12.5 < 25 | 0.0671 | 0.84 |
| >25 < 51 | 0.0320 | 0.40 |
| >51 | 0.0211 | 0.26 |
| Weight | 7.9790 | 100.00 |
| Starting | 7.9254 | |
| Recovery | 100.00% | |

+30 × 50 Mesh Combined Samples:

| | Weight Grams | Weight Dist. Wt. % | Iron Wt. % | Iron Dist. Wt. % | Cum. Wt. Rec. Wt. % | Iron Wt. % | Iron Rec. Wt. % |
|---|---|---|---|---|---|---|---|
| < 0.75 | 1.4131 | 17.71 | 0.27 | 10.14 | 17.71 | 0.27 | 10.14 |
| >0.75 < 1.5 | 5.2300 | 65.55 | 0.46 | 63.94 | 83.26 | 0.42 | 74.08 |
| >1.5 | 1.3359 | 16.74 | 0.73 | 25.92 | 100.00 | 0.47 | 100.00 |
| Sample Wt. (gm) | 7.9790 | 100.00 | 0.47 | 100.00 | | | |

TABLE XVI

Anorthite from Carlton Peak, Minnesota
50 × 100 Mesh Fraction

50 × 100 Mesh

| Magnetic Susceptibility $10^{-6}$ cgs/gm | Weight Recovery (Grams) | Wt. % |
|---|---|---|
| < 0.15 | 0.0012 | 0.02 |
| >0.15 < 0.38 | 0.0404 | 0.79 |
| >0.38 < 0.75 | 0.4059 | 7.95 |
| >0.75 < 1.5 | 3.8686 | 75.81 |
| >1.5 < 3 | 0.5286 | 10.36 |
| >3 < 6 | 0.0875 | 1.71 |
| >6 < 12.5 | 0.0698 | 1.37 |
| >12.5 < 25 | 0.0513 | 1.01 |
| >25 < 51 | 0.0256 | 0.50 |
| >51 | 0.0240 | 0.47 |
| Weight | 5.1029 | 100.00 |
| Starting | 5.1111 | |
| Recovery | 99.8% | |

+50 × 100 Mesh Combined Samples:

| | Weight Grams | Weight Dist. Wt. % | Iron Wt. % | Iron Dist. Wt. % | Cum. Wt. Rec. Wt. % | Iron Wt. % | Iron Rec. Wt. % |
|---|---|---|---|---|---|---|---|
| < 0.75 | 0.4475 | 8.77 | 0.22 | 3.96 | 8.77 | 0.22 | 3.96 |
| >0.75 < 1.5 | 3.8686 | 75.81 | 0.42 | 63.35 | 84.58 | 0.40 | 69.31 |
| >1.5 | 0.7868 | 15.42 | 0.97 | 30.69 | 100.00 | 0.49 | 100.00 |
| Sample Wt. (gm) | 5.1029 | 100.00 | 0.49 | 100.00 | | | |

TABLE XVII

Anorthite from Carlton Peak, Minnesota
100 × 200 Mesh Fraction

100 × 200 Mesh

| Magnetic Susceptibility $10^{-6}$ cgs/gm | Weight Recovery (Grams) | Wt. % |
|---|---|---|
| < 0.15 | 0.0035 | 0.14 |
| >0.15 < 0.38 | 0.0631 | 2.52 |
| >0.38 < 0.75 | 1.1921 | 47.56 |
| >0.75 < 1.5 | 0.8567 | 34.18 |
| >1.5 < 3 | 0.2956 | 11.79 |
| >3 < 6 | 0.0354 | 1.41 |
| >6 < 12.5 | 0.0238 | 0.95 |
| >12.5 < 25 | 0.0183 | 0.73 |
| >25 < 51 | 0.0125 | 0.50 |
| >51 | 0.0055 | 0.22 |
| Weight | 2.5065 | 100.00 |

TABLE XVII-continued

Anorthite from Carlton Peak, Minnesota
100 × 200 Mesh Fraction

Starting 2.5394
Recovery 98.7%

+100 × 200 Mesh Combined Samples:

| | Weight Grams | Weight Dist. Wt. % | Iron Wt. % | Iron Dist. Wt. % | Cum. Wt. Rec. Wt. % | Iron Wt. % | Iron Rec. Wt. % |
|---|---|---|---|---|---|---|---|
| < 0.75 | 1.2587 | 50.22 | 0.36 | 41.53 | 50.22 | 0.36 | 41.53 |
| >0.75 < 1.5 | 0.8567 | 34.18 | 0.48 | 37.69 | 84.40 | 0.41 | 79.21 |
| >1.5 | 0.3911 | 15.60 | 0.58 | 20.79 | 100.00 | 0.44 | 100.00 |
| Sample Wt. (gm) | 2.5065 | 100.00 | 0.44 | 100.00 | | | |

TABLE XVIII

Anorthite from Carlton Peak, Minnesota
200 × 325 Mesh Fraction

| Magnetic Susceptibility $10^{-6}$ cgs/gm | Weight Recovery (Grams) | Wt. % |
|---|---|---|
| | 200 × 325 Mesh | |
| < 0.15 | | |
| >0.15 < 0.38 | 0.0077 | 0.67 |
| >0.38 < 0.75 | 0.1906 | 16.56 |
| >0.75 < 1.5 | 0.7752 | 67.34 |
| >1.5 < 3 | 0.0695 | 6.04 |
| >3 < 6 | 0.0098 | 0.85 |
| >6 < 12.5 | 0.0074 | 0.64 |
| >12.5 < 25 | 0.0034 | 0.30 |
| >< 51 | 0.0130 | 1.13 |
| >51 | 0.0746 | 6.48 |
| Weight | 1.1512 | 100.00 |
| Starting | 1.2299 | |
| Recovery | 93.6% | |
| | −325 Mesh | |
| < 0.15 | | |
| >0.15 < 0.38 | | |
| >0.38 < 0.75 | 0.0311 | 3.45 |
| >0.75 < 1.5 | 0.2506 | 27.82 |
| >1.5 < 3 | 0.4736 | 52.57 |
| >3 < 6 | 0.0936 | 10.39 |
| >6 < 12.5 | 0.0395 | 4.38 |
| >12.5 < 25 | 0.0044 | 0.49 |
| >25 < 51 | 0.0081 | 0.90 |
| >51 | 0.0000 | 0.00 |
| Weight | 0.9009 | 100.00 |
| Starting | 0.9558 | |
| Recovery | 94.3% | |

+200 Mesh Combined Samples:

| | Weight Grams | Weight Dist. Wt. % | Iron Wt. % | Iron Dist. Wt. % | Cum. Wt. Rec. Wt. % | Iron Wt. % | Iron Rec. Wt. % |
|---|---|---|---|---|---|---|---|
| < 0.75 | 5.7902 | 21.37 | 0.30 | 14.79 | 21.37 | 0.30 | 16.17 |
| >0.75 < 1.5 | 14.1239 | 52.14 | 0.41 | 49.30 | 73.51 | 0.38 | 70.07 |
| >1.5 | 4.8675 | 17.97 | 0.66 | 27.38 | 91.48 | 0.43 | 100.00 |
| Sample Wt. (gm) | 24.7816 | 91.48 | 0.43 | 91.48 | | | |

The data of FIG. 11 indicate a large peak in the concentration of the paramagnetic fraction at a magnetic susceptibility of $0.75\times10^{-6}$ cc/gm. Anorthite concentrates in the weakly paramagnetic fraction with susceptibility less than that of the peak. There is no peak in the spectrum in the vicinity of $5\times10^{-6}$ cc/gm as was observed for the lunar soil sample corresponding to the presence of the agglutinates. A magnetic separator designed to concentrate low-iron-content anorthite from this material must have the capability of separating particles with susceptibilities as low as $0.4\times10^{-6}$ cc/gm.

Low iron content anorthitic mineral can be separated from the Carlton Peak material and is concentrated in the low susceptibility fractions. It is interesting to observe, however, that there is no diamagnetic fraction remaining in the Carlton Peak sample after separation of the paramagnetic material. Evidently the "pure" anorthite extracted from the Carlton Peak anorthosite contains enough "magnetic" iron or other magnetic species to make the mineral slightly paramagnetic.

MINNESOTA LUNAR SIMULANT 1 (MLS-1)

A 13 gram sample of MLS 1 was employed in an effort to determine if artificially prepared lunar simulants could be used in studies of the magnetic characteristics of lunar soils. This sample was prepared at the University of Minnesota starting with basaltic sill exposed at Duluth, Minn. The simulant is described as being similar in composition to Apollo 11 lunar mare soil sample No. 10084. [Paul W. Weiblen and Katherine L. Gordon, "Characteristics of a Simulant for Lunar Surface Materials," Paper No. LBS-88-213, presented at Lunar Bases and Space Activities in the 21st Century, Houston, Tex., Apr. 5-7, 1988] MagnetoGraph measurements on the simulant are significantly different from those of either the Carlton Peak terrestrial simulant or the lunar soil sample 64421. No material on earth is precisely similar to lunar soil.

MLS-1 contains biotite and a hydrous alteration product of olivine, as well as ferric iron and sodic plagioclase and some fine glassy components. These glassy inclusions are significantly different from the agglutinates, however, in that the magnetic component appears to be magnetite only. There is no evidence for the presence of elemental iron such as is found in agglutinates.

The simulant was screened into three portions, +150 microns, 44×150 microns, and minus 44 microns. MagnetoGraphs were prepared for the +150 micron fraction (1.28 grams) and for the 44×150 micron fraction (5.34 grams). Details of the measurements are given in the 3 tables below.

TABLE XIX

Minnesota Lunar Simulant 1, No. 5
+100 Mesh Fraction

| Screen Fraction | Weight (Grams) | Weight Wt. % |
|---|---|---|
| +100 | 1.2808 | 19.3 |
| 100 × 325 | 5.3404 | 80.4 |
| −325 | 0.0225 | 0.3 |
| | 6.6437 | 100.0 |

+100 Mesh

| Magnetic Susceptibility $10^{-6}$ cgs/gm | Sample Weight (Grams) | Weight Distribution Wt. % |
|---|---|---|
| < 0.3 | 0.0116 | 0.97 |
| >0.3 < 1.2 | 0.0298 | 2.48 |
| >1.2 < 2.3 | 0.0261 | 2.17 |
| >2.3 < 4.6 | 0.0307 | 2.56 |
| >4.6 < 9.3 | 0.0402 | 3.35 |
| >9.3 < 19 | 0.0953 | 7.94 |
| >19 < 38 | 0.1973 | 16.43 |
| >38 < 75 | 0.1521 | 12.66 |
| >75 < 150 | 0.1197 | 9.97 |
| >150 < 300 | 0.0517 | 4.30 |
| >300 < 644 | 0.0343 | 2.86 |
| >644 < 1240 | 0.0524 | 4.36 |
| >1240 < 3340 | 0.0897 | 7.47 |
| >3340 | 0.2701 | 22.49 |
| Weight | 1.2010 | 100.00 |
| Starting | 1.2767 | |
| Recovery | 94.1% | |

+100 Mesh Combined Samples:

| Magnetic Suscep. $10^{-6}$ (cc/gm) | Sample Weight Grams | Weight Dist. Wt. % | Iron Wt. % | Iron Dist. Wt. % | Cum. Wt. Rec. Wt. % | Iron Wt. % | Iron Rec. Wt. % |
|---|---|---|---|---|---|---|---|
| < 4.6 | 0.0982 | 8.18 | 0.43 | 0.71 | 8.18 | 0.43 | 0.71 |
| >4.6 < 19 | 0.1355 | 11.28 | 0.52 | 1.19 | 19.46 | 0.48 | 1.90 |
| >19 < 38 | 0.1973 | 16.43 | 2.50 | 8.30 | 35.89 | 1.41 | 10.20 |
| >38 < 150 | 0.2718 | 22.63 | 2.50 | 11.44 | 58.52 | 1.83 | 21.64 |
| >150 < 3400 | 0.2281 | 18.99 | 13.66 | 52.45 | 77.51 | 4.73 | 74.09 |
| >3400 < | 0.2701 | 22.49 | 5.70 | 25.91 | 100.00 | 4.95 | 100.00 |
| Sample Wt. (gm) | 1.201 | Iron | 4.95 | 100.00 | | | |

TABLE XX

Minnesota Lunar Simulant 1, No. 5
+325-100 Mesh Fraction

+325-100 Mesh Combined Samples:

| Magnetic Suscep. $10^{-6}$ (cc/gm) | Sample Weight Grams | Weight Dist. Wt. % | Iron Wt. % | Iron Dist. Wt. % | Cum. Wt. Rec. Wt. % | Iron Wt. % | Iron Rec. Wt. % |
|---|---|---|---|---|---|---|---|
| < 0.3 | 0.0819 | 1.56 | 0.46 | 0.34 | 1.56 | 0.46 | 21.71 |
| >0.3 < 1.2 | 0.2683 | 5.11 | 0.30 | 0.72 | 6.67 | 0.34 | 15.92 |
| >1.2 < 2.3 | 0.1794 | 3.42 | 0.43 | 0.69 | 10.09 | 0.37 | 17.40 |

TABLE XX-continued

| Minnesota Lunar Simulant 1, No. 5 +325-100 Mesh Fraction | | | | | | | |
|---|---|---|---|---|---|---|---|
| >2.3 < 4.6 | 0.2378 | 4.53 | 0.36 | 0.77 | 14.62 | 0.37 | 17.27 |
| >4.6 < 9.3 | 0.2037 | 3.88 | 1.07 | 1.96 | 18.50 | 0.51 | 24.24 |
| >9.3 < 19 | 0.4546 | 8.66 | 1.14 | 4.66 | 27.16 | 0.71 | 33.66 |
| >19 < 38 | 1.1916 | 22.70 | 1.36 | 14.57 | 49.85 | 1.01 | 47.55 |
| >38 < 75 | 0.6918 | 13.18 | 2.55 | 15.86 | 63.03 | 1.33 | 62.77 |
| >75 < 150 | 0.6400 | 12.19 | 2.95 | 16.97 | 75.22 | 1.59 | 75.15 |
| > 150 < 300 | 0.2397 | 4.57 | 1.76 | 3.79 | 79.79 | 1.60 | 75.61 |
| >300 < 644 | 0.1672 | 3.18 | 1.11 | 1.67 | 82.97 | 1.58 | 74.71 |
| >644 < 1240 | 0.1356 | 2.58 | 0.28 | 0.34 | 85.56 | 1.54 | 72.86 |
| >1240 < 3340 | 0.1206 | 2.30 | 0.22 | 0.24 | 87.85 | 1.51 | 71.22 |
| >3340 | 0.6377 | 12.15 | 6.53 | 37.43 | 100.00 | 2.12 | 100.00 |
| Sample Wt. (gm) Start | 5.2499 | Iron | 2.12 | | | | |
| | 5.3260 | | | | | | |
| Recovery | 98.6% | | | | | | |
| < 4.6 | 0.7674 | 14.62 | 0.37 | 2.52 | 14.62 | 0.37 | 2.52 |
| >4.6 < 19 | 0.6583 | 12.54 | 1.12 | 6.62 | 27.16 | 0.71 | 9.14 |
| >19 < 38 | 1.1916 | 22.70 | 1.36 | 14.57 | 49.85 | 1.01 | 23.71 |
| >38 < 150 | 1.3318 | 25.37 | 2.74 | 32.83 | 75.22 | 1.59 | 56.53 |
| >150 < 3400 | 0.6631 | 12.63 | 1.01 | 6.04 | 87.85 | 1.51 | 62.57 |
| >3400 | 0.6377 | 12.15 | 6.53 | 37.43 | 100.00 | 2.12 | 100.00 |
| Sample Wt. (gm) | 5.2499 | Iron | 2.12 | 100.00 | | | |

TABLE XXI

| Minnesota Lunar Simulant 1, No. 5 +44 Micron Fraction +44 Micron Combined Sample Recovery: | | | | | | | |
|---|---|---|---|---|---|---|---|
| Magnetic Suscep. $10^{-6}$ (cc/gm) | Sample Weight Grams | Weight Dist. Wt. % | Iron Wt. % | Iron Dist. Wt. % | Cum. Wt. Rec. Wt. % | Iron Wt. % | Iron Rec. Wt. % |
| < 4.6 | 0.8656 | 13.37 | 0.37 | 1.89 | 13.37 | 0.37 | 1.89 |
| >4.6 < 19 | 0.7938 | 12.26 | 1.02 | 4.73 | 25.64 | 0.68 | 6.60 |
| >19 < 38 | 1.3889 | 21.46 | 1.52 | 12.39 | 47.09 | 1.06 | 18.94 |
| >38 < 150 | 1.6036 | 24.77 | 2.70 | 25.38 | 71.87 | 1.63 | 44.24 |
| >150 < 3400 | 0.8912 | 13.77 | 4.25 | 22.19 | 85.64 | 2.05 | 66.35 |
| >3400 | 0.9078 | 14.02 | 6.28 | 33.42 | 99.66 | 2.65 | 99.66 |
| Sample Wt. (gm) | 6.4509 | 99.66 | 2.65 | 100.00 | | | |

Figure 13:
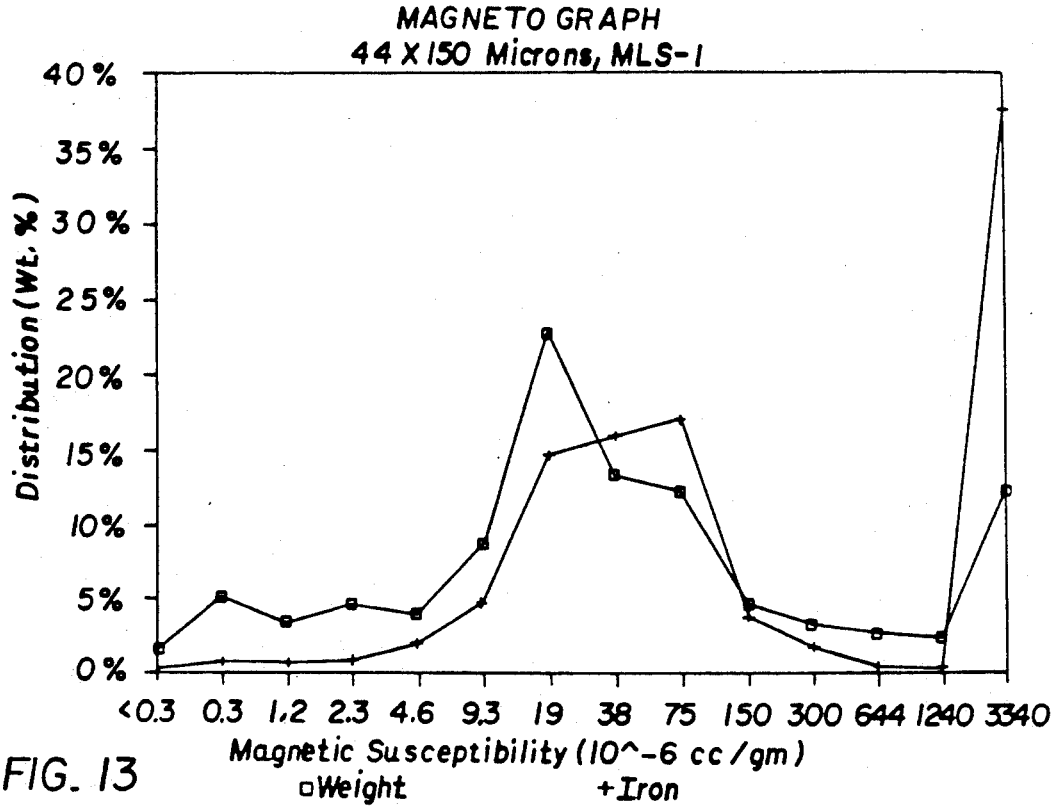
FIG. 13 illustrates a MagnetoGraph of a 44×150 micron sample of Lunar simulant.

FIG. 13 illustrates the observed distribution of iron in the magnetic fractions taken from a 5.3 gram sample of the 44×150 microns size component of MLS-1. It is apparent that the simulant contains strongly magnetic material. A white mineral-like substance concentrates in the weakly paramagnetic fractions with susceptibility less than nominally $10\times10^{-6}$ cc/gm. The paramagnetic fractions are dark in appearance and the strongly magnetic fraction with susceptibility greater than $1000\times10^{-6}$ cc/gm agglomerates and remains magnetized upon exiting the separator.

A magnetic separator designed to concentrate the weakly magnetic component from this material would be much simpler and significantly less costly to build and operate that one designed for processing Carlton Peak anorthosite. This is so because the susceptibility of separation is almost an order of magnitude higher for this simulant. Recovery of the strongly magnetic component would be even easier yet.

Figure 14:
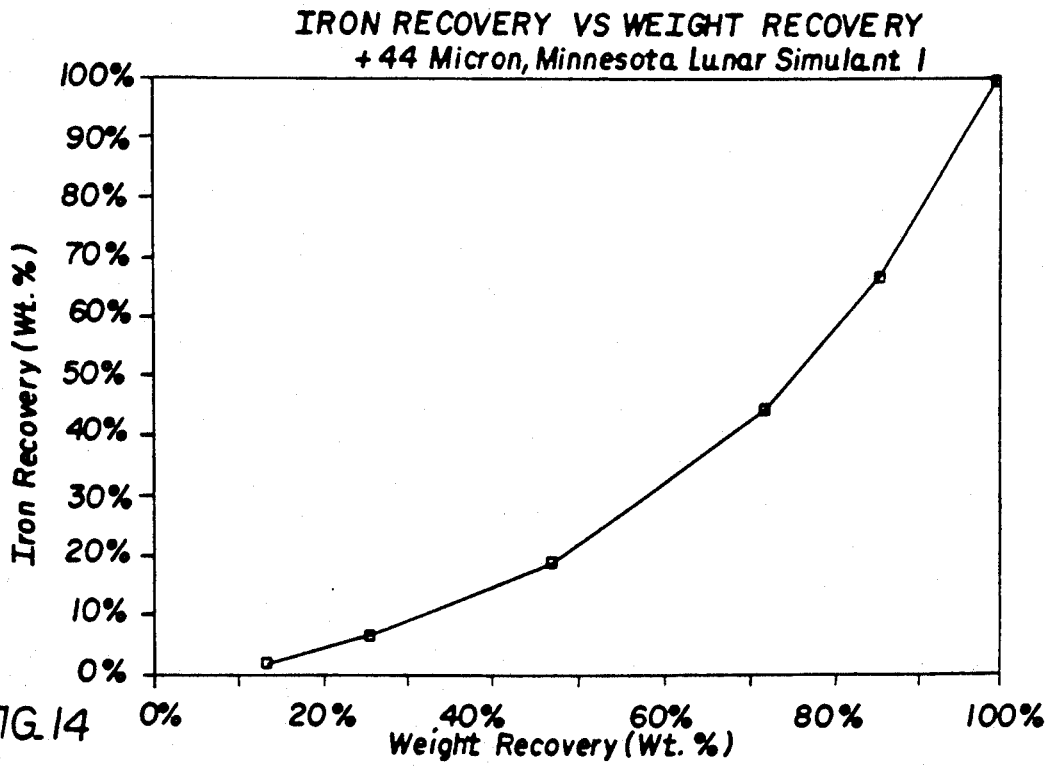
FIG. 14 illustrates iron recovery for the sample illustrated in FIG. 13.

As an example of the type of information which can be developed by the MagnetoGraph method, FIG. 14 shows the recovery of iron that is possible in magnetic processing of the +44 micron fraction of MLS-1. Over 90% of the iron in the feed sample is recovered in the fraction with susceptibility greater than about $20\times10^{-6}$ cc/gm. Less than 10% of the iron is recovered in the weakly magnetic fraction which contains about 30% of the original sample weight.

MAGNETOGRAPHS DEVELOPED IN FREE FALL SEPARATIONS

The method of the present invention can be practiced with use of a magnetic separator which is capable of preparing a series of magnetic isolates of differing magnetic susceptibilities. The following examples illustrate the use of a free fall mode of operation of a magnetic separator to prepare MagnetoGraphs and to use the magnetic susceptibilities determined in the MagnetoGraph to prepare groupings for subsequent magnetic separation of the weakly magnetic material into a multiplicity of magnetic fractions of differing characteristics. The material used in the examples is coal.

The free fall method has several significant advantages when compared to the tray method in that substantially more material can be processed than can be reasonably analyzed using the tray arrangement of the Frantz Isodynamic Separator. Coal throughputs with this arrangement are typically 10 to 20 pounds per hour as opposed to grams per minute for the tray method. Because of this, measurements with the free fall method are more representative of practical applications and can be more sensitive to chemical and physical characteristics of the test material since larger samples can be analyzed. Further, since a separate magnetic susceptibility apparatus is used in the free fall mode of operation, the method can be made more rigorous and more sensitive to small values of the magnetic susceptibility than the tray method.

Figure 15:
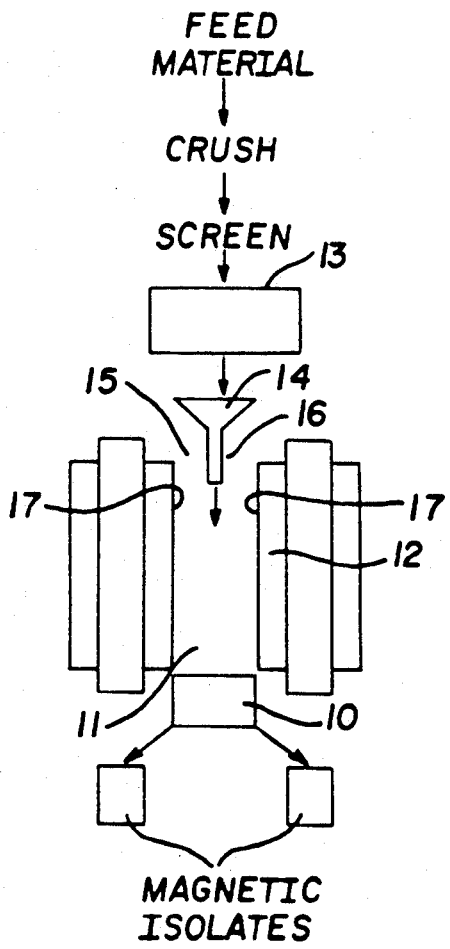
FIG. 15 illustrates individual steps and components of a preferred method of and apparatus for practicing the present invention.
Figure 16:
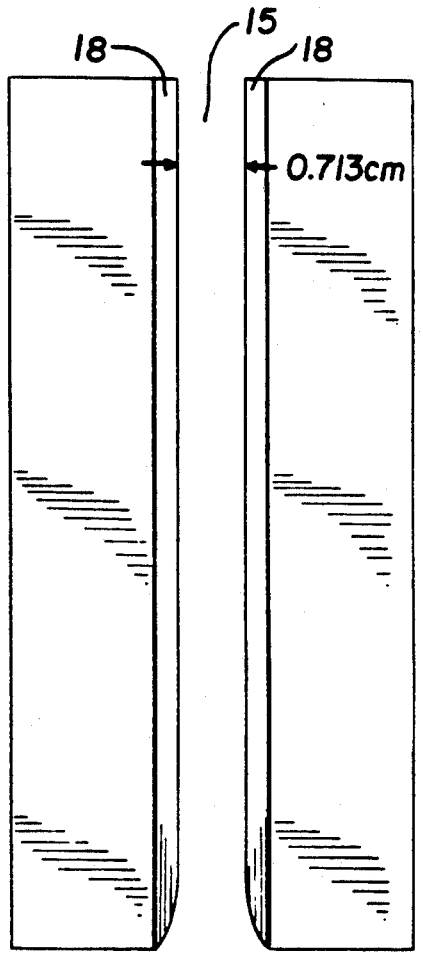
FIG. 16 illustrates a view of magnetic poles used in carrying out a preferred embodiment of the present invention.
Figure 17:
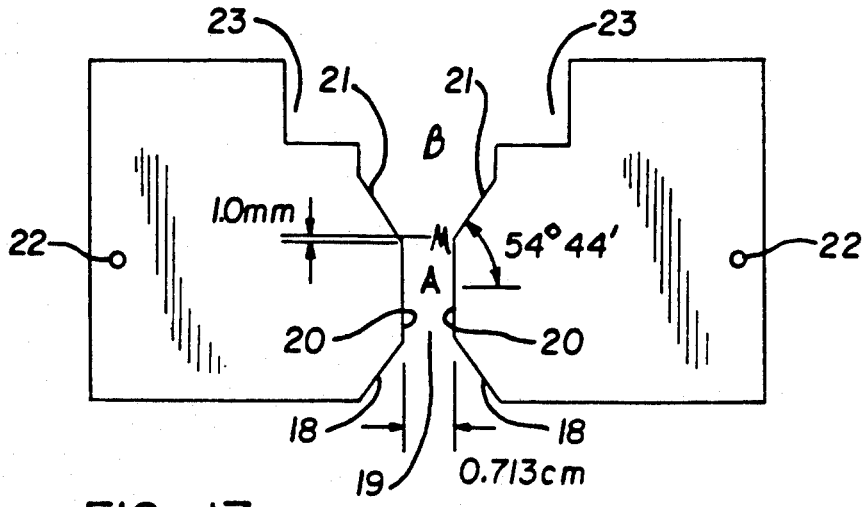
FIG. 17 illustrates a view of magnetic poles used in carrying out a preferred embodiment of the present invention.

Referring to FIGS. 15-17; 19-26 and 31-33, the free fall method of the present invention uses a mechanical splitter 10 at the exit port 11 of the separator 12 to isolate multiple fractions of different magnetic susceptibility prepared in single or multiple pass through the separator 12. An independent magnetic susceptibility balance (not shown) is used to measure the magnetic susceptibility of the different magnetic fractions. In the work reported here we have used a Johnson Matthey Magnetic Susceptibility Balance which can be obtained from Johnson Matthey, Inc., AESAR Group, Eagles Landing, 892 Lafayette Road, Seabrook, N.H. 03874.

The individual steps of the method are illustrated in FIG. 15. The feed material is air dried and crushed to a suitable topsize. The material is then screened into a multiplicity of screen fractions suitable for subsequent dry magnetic processing. In the examples to follow, coal between 8 mesh topsize and 100 mesh is used to illustrate the method of the invention.

The topsize of particles separated will be as coarse as possible depending upon the nature of the material and the largest opening available between the poles of the magnetic separator. The Frantz Isodynamic Separator is restricted to a pole opening of nominally 3.9 mm at its narrowest point. This imposes a practical upper limit of about 0.6 mm (30 mesh) for separations in the free fall mode of operation. In the examples to follow, the electromagnet supplied with the Frantz Isodynamic Separator was used to generate the magnetizing fields but the isodynamic poles were removed and replaced with newly designed poles having an opening of 7.1 mm at their narrowest points thus allowing separations with particles up to 2.4 mm (8 mesh).

The finest particle size processed will generally be in the 20 to 100 micron size range. Severe problems associated with self agglomeration and with air conveyance are generally encountered for finer sized particles.

The product of screening is fed to a continuous feeder which provides a steady stream of material to the magnetic separator 12. For the arrangement used with the Frantz electromagnet, a vibratory feeder 13 was employed.

The vibratory feeder outflow was fed into a conical hopper 14 located above the pole opening 15 at the top of the magnetic separator 12. The hopper assembly supplied with the Frantz includes cone bottom inserts of differing diameter openings for the purpose of providing feed streams of different cross-sections and throughputs. The Frantz cone insert as supplied terminates flush with the bottom of the cone and stands 2.3 centimeters above the top of the magnet poles. The Franz cone has proven inadequate for practicing the present invention. The sloped sidewalls of the cone impart a horizontal component of motion to the particles, in addition to the vertical component due to gravity. This horizontal component in turn causes many particles to collide with the magnet poles, adversely affecting reliable separation.

For the purpose of this work, the cone insert supplied with the Frantz is replaced by a newly designed insert which has a hollow tube, or collimator, 16 extending 1.7 cm below the bottom of the cone into the top of the magnetic separator gap 15. This tube serves to collimate the stream of particles and to restrict their motion to the downward direction only, thereby avoiding inadvertent collisions of the incoming particles with the upper portions of the magnet poles 17. Particle collisions with the magnet poles are to be avoided.

In the Frantz apparatus the cone is supported on a track assembly centered over the pole opening. With the newly designed mechanism, the cone position is adjustable, as the entrance point of the particles can be placed anywhere along the line from back to front of the magnet in the center plane between the poles.

As the material being separated falls through the magnetized region in the opening between the magnet poles, the action of the gradient magnetic field produced by the magnetic separator will cause the paramagnetic particles to move along a line transverse to the direction of fall and the direction of the magnetic field into the regions of higher magnetic field strength and the diamagnetic particles to move into regions of lower magnetic field strength. This tendency to separate is disrupted by the effects of collisions between the particles as they pass through the separator. Collisions between paramagnetic and diamagnetic particles as they move under the action of the gradient magnetic field are particularly bothersome because of their oppositely directed momenta.

MAGNETIC SEPARATOR POLES

FIG. 16 is a front view of one set of poles used with the Frantz electromagnet in free fall mode of operation. All magnet poles employed were machined from 99.5% pure soft iron and annealed in a dry hydrogen atmosphere at 1550° Fahrenheit for one hour. These poles are used to replace the narrow gap isodynamic poles in the Frantz electromagnet. The particles fall from the top of the magnet in the opening 15 between these poles.

FIG. 17 is a top view of one set of poles according to a preferred embodiment of the present invention viewed from above. For these poles, the magnetic field and energy gradient vary with distance along a line from back to front of the poles. The regions of high magnetic energy gradient used in making the magnetic separations employing the method of this invention are located along the edges 18 of the flat portions of the poles where the iron slopes away from the pole gap 19. The high gradient region extends along the entire length of the pole as shown in the front view of FIG. 16.

Figure 18:
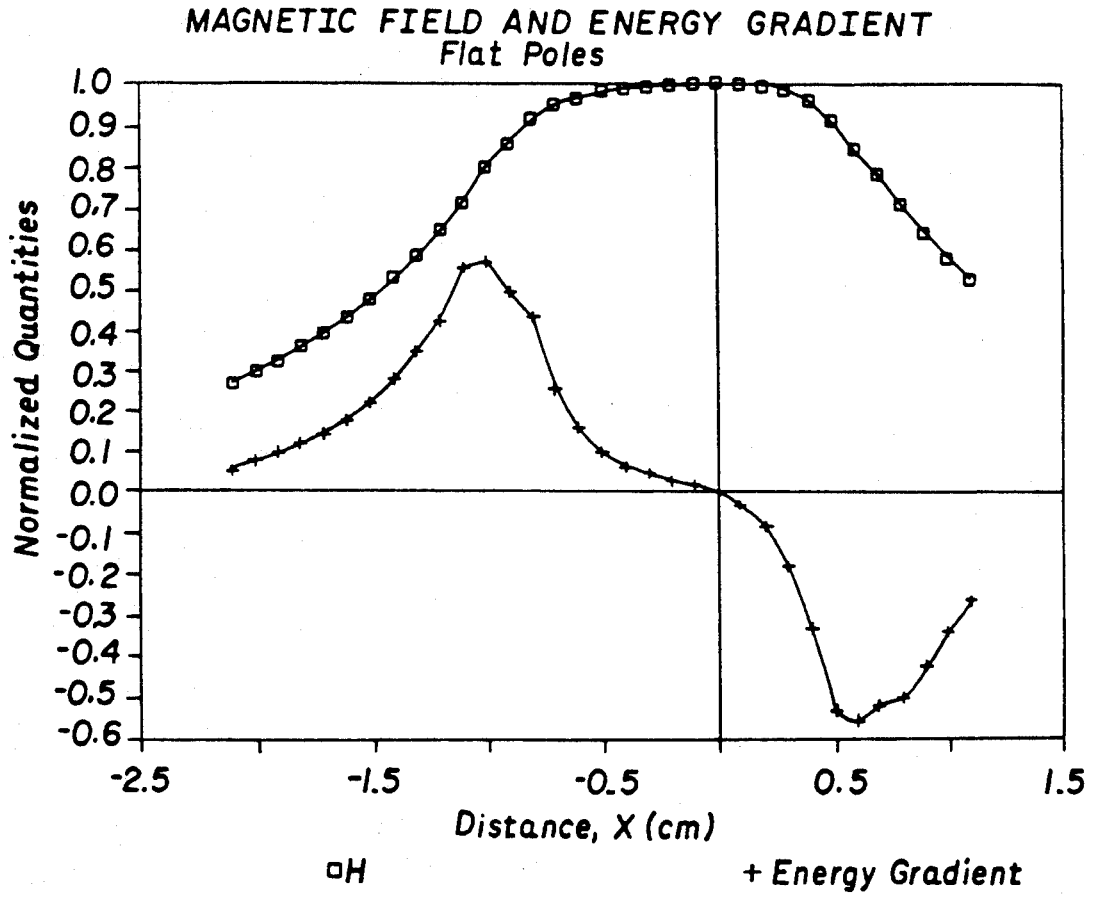
FIG. 18 illustrates magnetic field strength and magnetic energy grandient vs. distance from front to back of magnet.

The magnetic field is roughly constant in the region 20 where the poles are parallel. Outside this region, where the poles slope away, 21 the field drops off rapidly. The measured variations of normalized magnetic field strength and magnetic energy gradient are shown in FIG. 18 where they are plotted versus the distance along the line from back to front of the magnet in the center plane between the pole faces. The width of the flat portion of the poles is 1.4 cm and the distance between peaks in the energy gradient curve is approximately 1.6 cm. The magnetic energy gradient reaches a maximum approximately 1 mm away from the intersections of the sloping and the parallel surfaces of the poles in the region of decreasing field strength. This is the preferred region M where the magnetic separation of the present invention is carried out.

Various poles have been employed in this work where the width of the flat portion of the pole is varied from zero to a maximum value of 1.4 cm. The field and energy gradient curves for these poles are essentially like those of FIG. 18 except that the width of the flat portions of both curves are less. All poles were designed to produce the same peak magnetic energy gradient, approximately 100M gauss²/cm. The principle, of operating at the peak force, is the same for all poles.

With this arrangement, paramagnetic particles will be attracted into the region A where the poles are parallel and diamagnetic particles will be forced outward into the regions B of lower field strength. This arrangement has the advantage in coal processing that the space volume for the diamagnetic coal fraction is greater than that for the paramagnetic mineral refuse fraction. Because of this, the particles will always separate in a manner which expands the falling stream of particles thus improving separations by lowering the tendency for particles of opposite magnetism to collide.

The holes 22 indicated on the top of the poles in FIG. 17 are for affixing the cone arrangement which introduces the particles into the magnetic separator. The cutout 23 indicated in the top portion of FIG. 17 is for attaching the poles to the Frantz Electromagnet structure and does not play a significant role in determining the magnetic characteristics of the separator.

Figure 19:
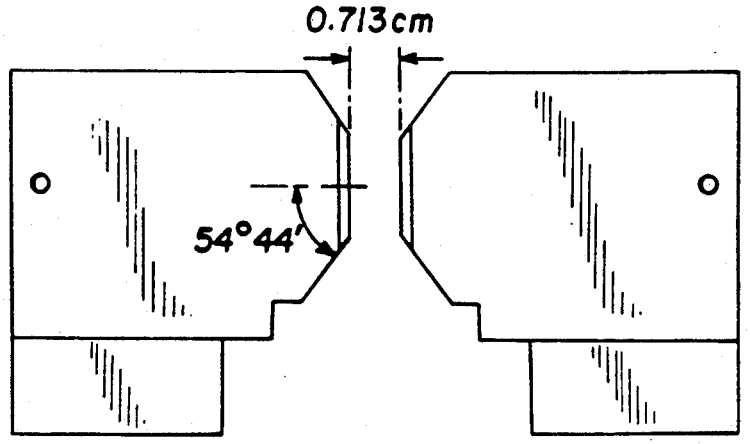
FIG. 19 illustrates a view of magnetic poles used in practicing a preferred embodiment of the present invention.
Figure 21:
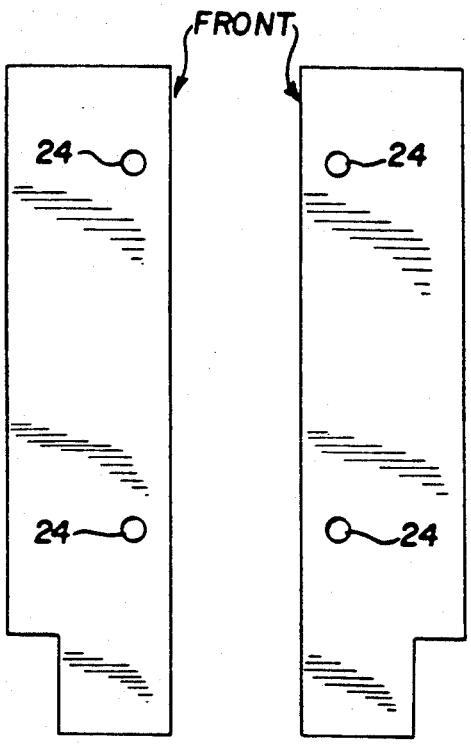
FIG. 21 illustrates a left view of magnetic poles used in practicing a preferred embodiment of the present invention.
Figure 20:
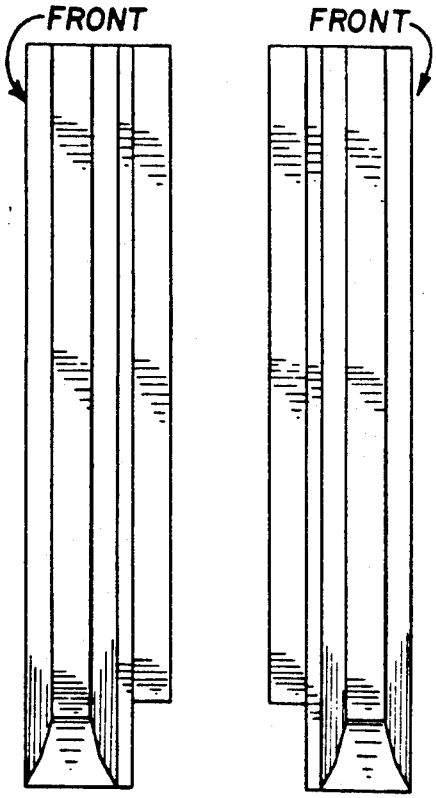
FIG. 20 illustrates a right view of magnetic poles used in practicing a preferred embodiment of the present invention.
Figure 22:
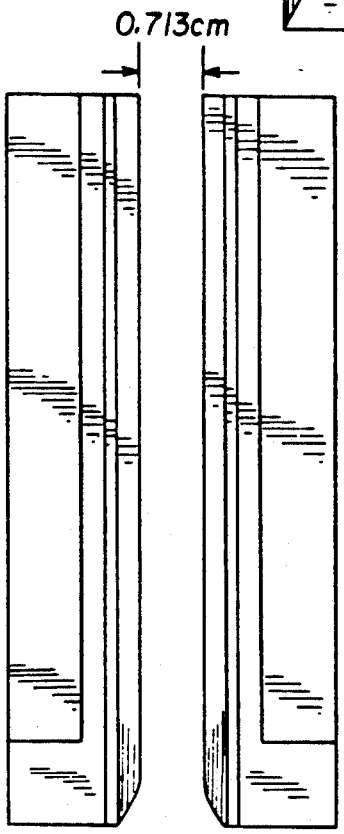
FIG. 22 illustrates a back view of magnetic poles used in practicing a preferred embodiment of the present invention.
Figure 23G:
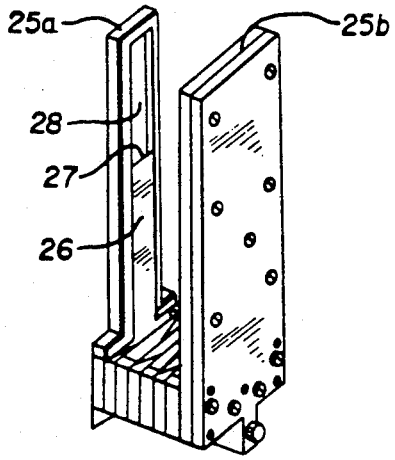
FIGS. 23 (*a*)–(*g*) illustrate front, left, top, right, back and bottom views of a preferred separation apparatus without collection canisters.
Figure 23C:
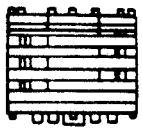
Figure 23B:
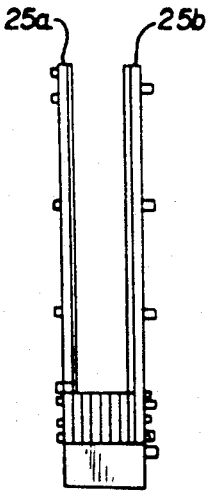
Figure 23A:
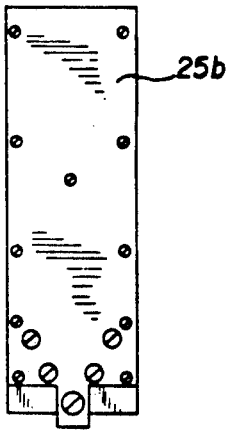
Figure 23D:
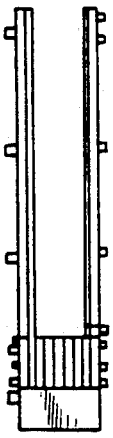
Figure 23E:
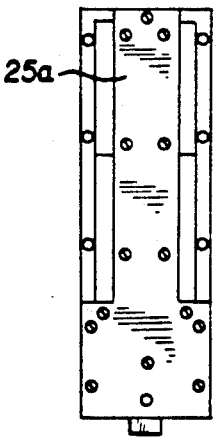
Figure 23F:
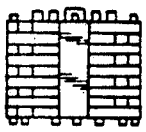
Figure 24G:
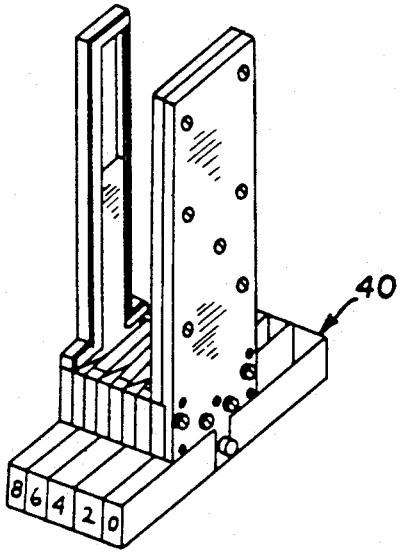
FIGS. 24 (*a*)–(*g*) illustrate a splitter apparatus of a preferred embodiment of the present invention, with collection canisters in place.
Figure 24C:
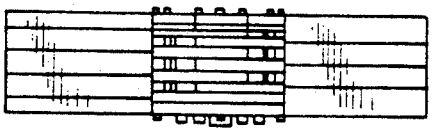
Figure 24B:
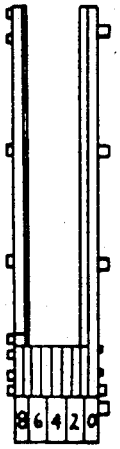
Figure 24A:
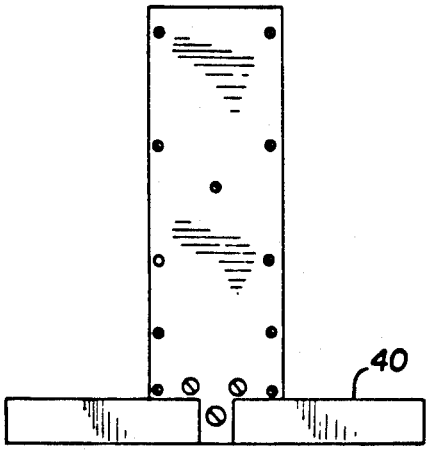
Figure 24D:
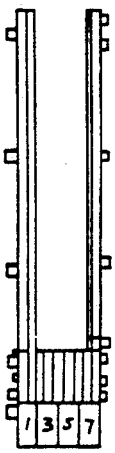
Figure 24E:
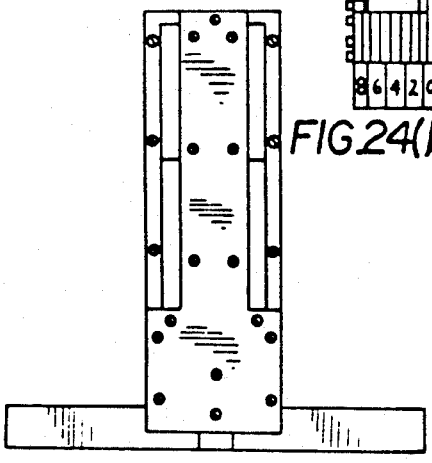
Figure 24F:
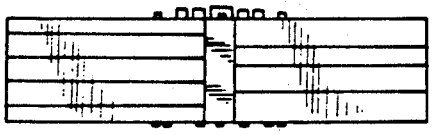

FIG. 19 is a bottom view of the poles. FIG. 20, right view of the poles, shows the poles as they would appear looking into the iron-return faces of the electromagnet. The cutaway at the top and the bottom of the poles is to reduce vertical magnetic forces on the particles as they enter and exit the magnetic separator. FIG. 21 is a left view of the poles. The holes 24 are countersunk and threaded to receive bolts passing through the arms of the iron-return frame of the Frantz electromagnet. The bolts are used to attach the poles to the face of the electromagnet. FIG. 22 is a back view of the poles.

SPLITTER APPARATUS

The region of space 15 between the magnet poles is enclosed by a splitter apparatus which is made of nonmagnetic material. This apparatus serves to contain the particulate material being processed within the magnetic separation region, to channel the flow of air and particulates, and to provide a means for separation and collection of the many different magnetic fractions as they exit the magnetic separator.

FIG. 23 shows front, (a) left, (b) top, (c) right, (d) back, (e) and bottom (f) views of the separation apparatus without the collection canister 40. FIG. 23 also shows a perspective view (g) of the apparatus illustrating how the separated material is removed from the collection apparatus.

Figure 25:
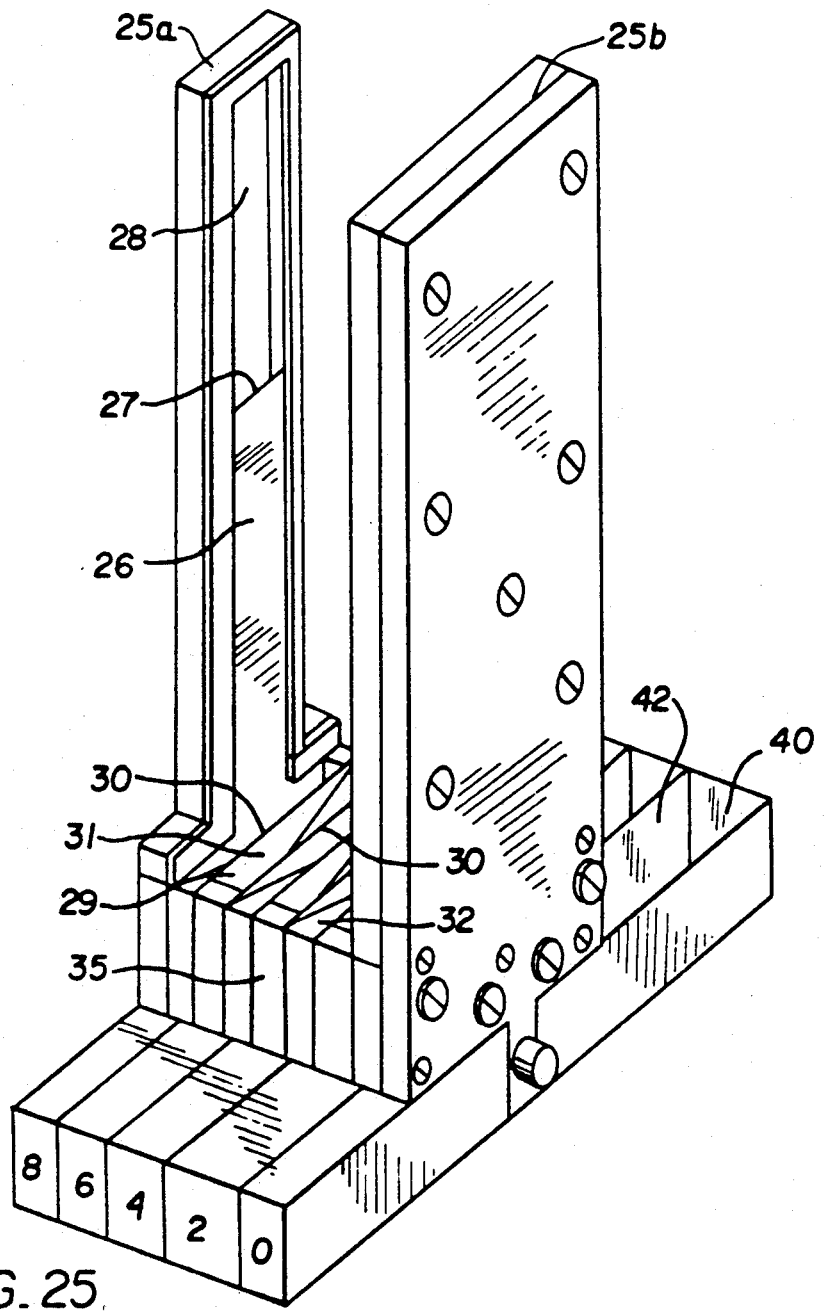
FIG. 25 illustrates an enlarged perspective view of a splitter apparatus of a preferred embodiment of the present invention, with collection canisters in place.

Referring now to FIGS. 23–25, the splitter means of the present invention will be described in detail. The splitter means, generally 1, comprises at least one elongated end member 25 which is adapted to collect strongly diamagnetic particles contained in a raw sample being processed by the separator.

Preferably, the splitter means includes a pair of elongated end members 25*a* and 25*b*, positioned on either side of the splitter means an issustrated in FIG. 23(*g*).

The elongated end members 25 are positioned along the space 15 between the poles, thereby preventing strongly diamagnetic particular from geing thrown clear of the magnetic separator and avoiding collection as a result of the magnetic forces acting upon such particles.

The elongated end member preferably include a particle collection drop chute 27 defined by an inner wall or partition 26 spaced from an exterior wall 28. As shown in FIG. 23(*g*), the partition 26 extends only partially the length of the elongated end member, thereby permitting the strongly diamagnetic particles to access the drop chute 27 by being thrown over the inner wall 26 towards the outer wall 28 by the magnetic forces acting on such particles. The particles thus drop down the drop chute 27 for collection.

As best seen in FIG. 25, the splitter means also preferably includes one or more splitter chambers 29 arranged ajacent the elongated side members 25. Each splitter chamber 29 includes two spaced-apart side walls 30 facing each other and having an open top 31 for receiving one fraction of the raw sample in the space defined by the side walls 30.

The two elongated vertical end members 25 of the apparatus shown in FIG. 23 serve to close the front and back of the electromagnet pole openings and to provide a frame and closure for the splitter partition 26 which terminates approximately half way up the face of the magnet. The partition 26 for the back elongated end member 25*a* can be seen on the inside of the back elongated end member 25*a*. The height of this partition can be changed as needed. Material which enters over the top of this partition on either the front or back plate is strongly diamagnetic since the collection region lies outside the magnet pole region and admits material which has traveled less than the full separator path length.

Figure 31:
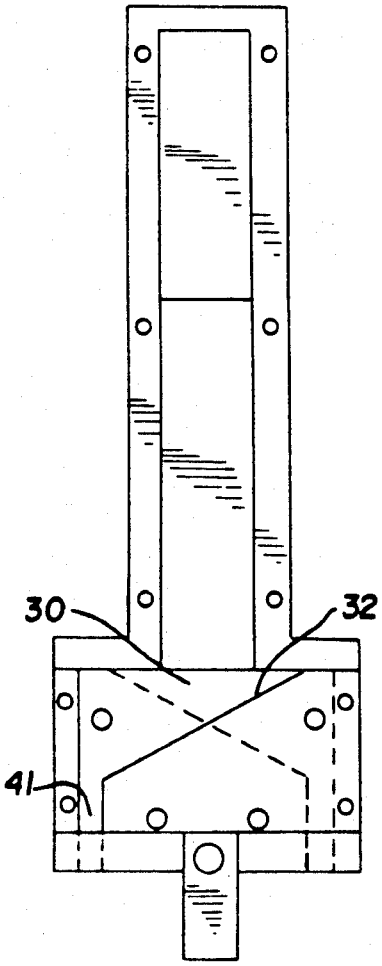
FIG. 31 illustrates a side elevation view of the splitter illustrated in FIG. 24, with one end member removed to provide an internal view of the splitter.

FIG. 24 shows the splitter apparatus with the collection canisters 40 in place and FIG. 25 is an enlarged perspective view of the apparatus. As can be seen from FIG. 25, particles which fall into the partitions between the front and back plates will be directed laterally outward into collection canisters 40 which are separate from the splitter apparatus and which slide into place under the edge of the separation apparatus. As illustrated in FIG. 31, adjacent splitter chambers of the separation apparatus include an inclined surface 32 positioned between the side walls 30. The inclined surface 32 slopes outwardly to opposite sides of the apparatus where an exit port is provided to allow the material sliding down the slope to drop into the canisters 40 located underneath. Each exit port 41 is in communication with a cannister 40. The cannisters 40 are preferably open to the atmosphere, to allow air to escape. This arrangement permits the use of wider receiving canisters than would be possible with all partitions sloping in the same direction and all material exiting the splitter on the same side.

Figure 32:
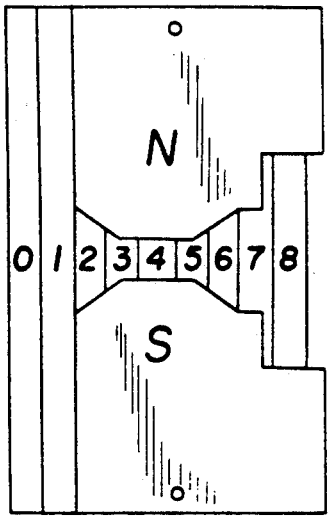
FIG. 32 illustrates an overhead schematic view of the splitter of FIG. 24 in position relative to north and south magnetic poles used in a preferenced embodiment of the present invention.
Figure 33:
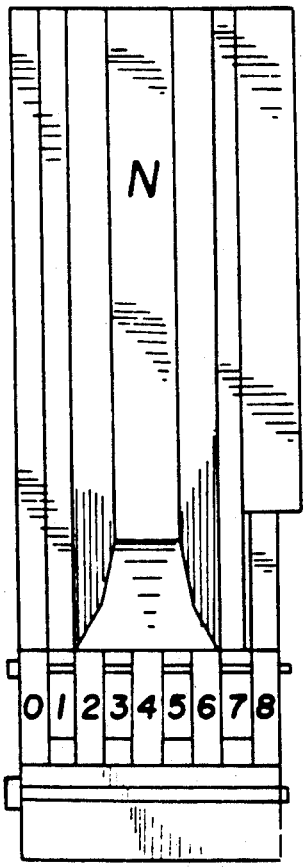
FIG. 33 illustrates a side elevation schematic view of the splitter illustrated in FIG. 24 in relation to one magnetic pole used in a preferred embodiment of the invention.

As illustrated in FIG. 24, the canisters 40 are numbered 0 through 8. Canister #4 is located in the middle of the pole width along the line from front to back of the magnet pole opening. This canister is designed to receive the most magnetic fraction. In the case of coal, this will be refuse. Referring to FIGS. 32 and 33, canisters 0 and 8 are located at the front and back of the magnet respectively. These canisters open approximately half way up the face of the magnet poles and are designed to receive material which has been displaced out of the magnetic region. Canisters 3 and 5 are located near the edges where the flat and sloping portions of the poles intersect. These canisters will receive material of intermediate magnetic susceptibility. For coal this will be a middling product. Canisters 6 and 7 lie outside the pole width of the magnetic separator. They are designed to receive material ranging from diamagnetic to paramagnetic. Canister No. 1 will normally receive diamagnetic material when the feed stream is admitted to the top of the separator at a position located over the splitter chamber corresponding to Canister No. 2. The center of the splitter chamber corresponding to Canister No. 2 corresponds roughly to the location of the maximum magnetic force when the flat poles described above are used.

For the case of coal, Canister No. 1 will contain the clean product. Canister No. 2 will receive very weakly magnetic middling material.

The canisters are designed for independent removal from the splitter apparatus so that they can be emptied as needed in the course of the separation run. As illustrated in FIG. 25, the cannisters 40 preferably have vertical walls 42 which prevent mixing of the different collected fractions. Additionally, the splitter chambers 29 each have end walls 35 to assist in containing the separated fractions and ensure unmixed collection by the cannisters 40.

A unique feature of the apparatus is the ability to separate particle and air flows as they exit the magnetized separation chamber. As particulates fall through the separation chamber, there is a tendency to carry entrained air with the flow. Since the separation chamber is closed on both sides, there would be no place for the air to exit the separation chamber once the particles had fallen into the canisters, if the bottom of the splitter apparatus were not open to the atmosphere. In the present apparatus, both air and particulates fall into the canisters and the air is returned to the atmosphere outside of the separator, through the open cannister tops.

Without the above feature for removing the air after particle separation, the air which travels with the particles through the separator would return up the separation chamber disrupting the particle flow patterns and destroying the separation efficiency.

EXAMPLES

MagnetoGraphs can be prepared in free fall mode of operation of the Frantz magnetic separator. Preparation of MagnetoGraphs is not restricted to use of the tray arrangement. This is important when large amounts of material are to be processed and when greater sensitivity is required, especially when dealing with weakly magnetic materials where tray operation is questionable.

Further, when processing weakly magnetic materials, more efficient separations can be achieved in practice when the procedure of the present invention is followed.

MAGNETOGRAPHS PREPARED BY FREE FALL SEPARATION

To illustrate the preparation of MagnetoGraphs using the free fall mode of operation a 30×50 mesh fraction of a Lower Kittanning seam coal from Clearfield County, Pa., was processed in free fall using the Frantz electromagnet with pole pieces designed to pass particles up to 8 mesh. The coal was characterized by 11.02% ash and 4.74% sulfur.

Figure 26:
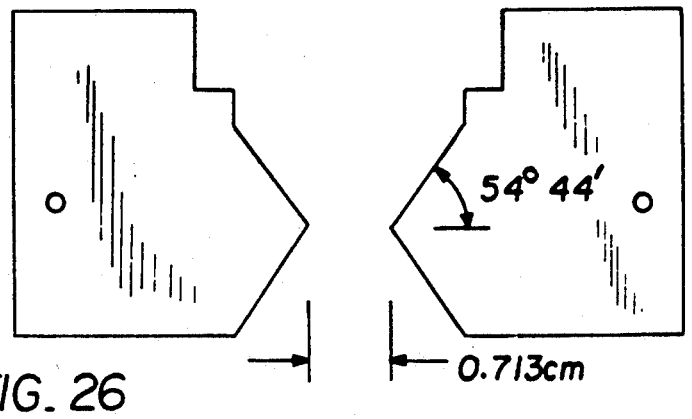
FIG. 26 illustrates a top view of V-shaped poles.

The pole pieces used for these measurements were similar to those illustrated in FIGS. 16 through 22 except that they have tips and are not flattened. All other dimensions are the same. The poles are designed to produce the same maximum level of magnetic energy gradient, 100 million Gauss$^2$/cm, as that produced by the flattened poles except that the maxima are closer together because of the absence of flattened pole faces. A top view of the pole tips used for these measurements is shown in FIG. 26.

The same canisters are employed as are illustrated in FIGS. 23 through 25. Test coal is dropped into the top of the magnet gap in the center plane between the poles at a distance from the edge of the pole tip corresponding to the location of the maximum in the magnetic energy gradient.

The location of the maximum energy gradient can be determined from magnetic field measurements. For this work, however, the position of the peak force was determined experimentally by locating the entry point in the midplane which gives the maximum deflection to 60 mesh diamagnetic sand particles dropped into the splitter with the magnet energized. Entrance along this line assures that the test particles will experience the maximum magnetic force.

FREE FALL TEST PROCEDURE

First, the coal was dropped through the separator with the magnet fully energized for the purpose of "scalping" strongly magnetic particles from the coal in a "pre-cleaning" step. This resulted in capture of strongly magnetic particles on the pole tip which represented 1.64% of the weight of the entire sample and which were characterized by an ash level of 45.76%, a sulfur level of 31.39%, and a magnetic susceptibility of $18.7\times10^{-6}$ cc/gm.

Next, the "pre-cleaned" coal from the first pass was reprocessed through the separator with the magnet at full strength and nine samples were collected in the canisters labeled 0 through 8. For the second pass, the coal was introduced into the separator so as to land in canister #3 when no magnetic field was applied. This location corresponds to the maximum in the magnetic energy gradient for the V-shaped poles used. The weight, ash, and sulfur was determined for the material landing in each of the 9 canisters. These data are shown in Table XXII. The statistical correlation observed between magnetic susceptibility and the ash and sulfur levels of the separated coal components is given at the bottom of the table.

TABLE XXII

RESULTS OF FIRST PASS EXPLORATORY SEPARATION OF "PRE-CLEANED" 30 × 50 MESH LOWER KITTANNING COAL

| CANISTER NUMBER | FRACTION | RECOVERY WT % | MAGNETIC SUSCEPTIBILITY MICRO CC/GM | ASH WT % | SULFUR WT % |
|---|---|---|---|---|---|
| 0 | M | 0.06 | +0.58 | 18.99 | 8.52 |
| 1 | M | 3.72 | +0.09 | 12.09 | 5.28 |
| 2 | C | 63.51 | −0.40 | 5.75 | 2.05 |
| 3 | M | 18.79 | 0.00 | 13.91 | 5.33 |
| 4 | R | 6.70 | +0.98 | 28.99 | 14.38 |
| 5 | M | 2.46 | +1.02 | 25.65 | 12.07 |
| 6 | R | 1.35 | +1.36 | 31.74 | 12.64 |
| 7 | R | 1.76 | +1.64 | 37.51 | 16.43 |
| 8 | R | 0.02 | +1.83 | 34.13 | 16.36 |

TABLE XXII-continued

RESULTS OF FIRST PASS EXPLORATORY SEPARATION OF "PRE-CLEANED" 30 × 50 MESH LOWER KITTANNING COAL

| CANISTER NUMBER | FRACTION | RECOVERY WT % | MAGNETIC SUSCEPTIBILITY MICRO CC/GM | ASH WT % | SULFUR WT % |
|---|---|---|---|---|---|
| | | Composite | −0.11 | 11.14 | 4.74 |

Magnetic Susceptibility = −0.79 + 0.051A + 0.038S ($10^{-6}$ cc/gm),
Correlation Coefficient = 0.96

The bulk of the coal is diamagnetic and exits the separator in Canister 2 as was expected. The magnetic susceptibility of the material that passes through the separator without deflection was too small to be measured. The ash and sulfur levels of the diamagnetic material are significantly lower than that of the paramagnetic material which has been separated from it.

The correlation of susceptibility with ash and sulfur indicates that the ash and sulfur free coal is diamagnetic and that the ash and sulfur separated in the first pass make paramagnetic contributions to the magnetic susceptibility.

A surprising discovery of this work is the fact that paramagnetic material is displaced out of the separator into the regions of low field strength and exits in canisters 0 and 1 and 7 and 8. While this fact is not fully understood at this time, it is believed due to interaction of the paramagnetic and diamagnetic particles in the outer shells of the coal stream as it falls through the separator. Since the diamagnetic coal component is in predominance in the first pass, it can push paramagnetic mineral matter out of the high force region if the minerals are on the wrong side of the stream.

Next, the contents of the different canisters were grouped into samples of differing magnetic susceptibility, ash, and sulfur levels for the purpose of providing feedstock for a second pass separation. The groupings were determined on the basis of magnetic susceptibility, ash, and sulfur levels. Clean coal is the diamagnetic fraction, the middling fraction was material with paramagnetic susceptibility less than about $1\times10^{-6}$ cc/gm and ash and sulfur up to nominally 25% and 12% respectively. The refuse fraction was the remainder of the material. These components, identified under the heading FRACTION in Table XXII are clean coal (Canister #2 only), middling (Canisters #0, 1, 3, and 5), and refuse (Canisters #4, 6, 7, and 8). The clean coal, the middling, and the refuse fractions were each reprocessed through the magnetic separator as separate feedstocks. The results of the second pass are given in Tables XXIII through XXV for the three fractions.

TABLE XXIII

PRODUCTS OF SECOND PASS SEPARATION OF "PRE-CLEANED" 30 × 50 MESH LOWER KITTANNING CLEAN COAL FRACTION

| CANISTER NUMBER | RECOVERY WT % | MAGNETIC SUSCEPTIBILITY MICRO CC/GM | ASH WT % | SULFUR WT % |
|---|---|---|---|---|
| 0 | 0.00 | | | |
| 1 | 2.60 | −0.42 | 5.74 | 2.17 |
| 2 | 76.93 | −0.49 | 4.86 | 1.72 |
| 3 | 15.39 | −0.36 | 8.131 | 2.74 |
| 4 | 2.64 | +0.50 | 12.90 | 5.63 |
| 5 | 1.41 | −0.27 | 8.345 | 3.19 |
| 6 | 0.57 | −0.02 | 10.13 | 3.83 |
| 7 | 0.44 | +0.20 | 14.71 | 5.76 |
| 8 | 0.00 | | | |

TABLE XXIII-continued

PRODUCTS OF SECOND PASS SEPARATION OF "PRE-CLEANED" 30 × 50 MESH LOWER KITTANNING CLEAN COAL FRACTION

| CANISTER NUMBER | RECOVERY WT % | MAGNETIC SUSCEPTIBILITY MICRO CC/GM | ASH WT % | SULFUR WT % |
|---|---|---|---|---|
| | Composite | −0.43 | 5.72 | 2.04 |

Magnetic Susceptibility = −0.73 − 0.13A + 0.53S ($10^{-6}$ cc/gm),
Correlation Coefficient = 0.97

TABLE XXIV

PRODUCTS OF SECOND PASS SEPARATION OF "PRE-CLEANED" 30 × 50 MESH LOWER KITTANNING MIDDLING COAL FRACTION

| CANISTER NUMBER | RECOVERY WT % | MAGNETIC SUSCEPTIBILITY MICRO CC/GM | ASH WT % | SULFUR WT % |
|---|---|---|---|---|
| 0 | 0.00 | | | |
| 1 | 3.55 | +0.21 | 15.04 | 6.43 |
| 2 | 40.19 | −0.36 | 7.41 | 2.67 |
| 3 | 37.66 | +0.11 | 15.03 | 5.75 |
| 4 | 11.38 | +0.92 | 27.47 | 13.32 |
| 5 | 3.25 | +1.06 | 27.84 | 12.70 |
| 6 | 1.73 | +1.24 | 33.22 | 14.76 |
| 7 | 2.23 | +1.57 | 36.79 | 16.35 |
| 8 | 0.00 | | | |
| | Composite | +0.10 | 14.60 | 6.02 |

Magnetic Susceptibility = −0.79 + 0.054A + 0.022S ($10^{-6}$ cc/gm),
Correlation Coefficient = 0.99

TABLE XXV

PRODUCTS OF SECOND PASS SEPARATION OF "PRE-CLEANED" 30 × 50 MESH LOWER KITTANNING REFUSE COAL FRACTION

| CANISTER NUMBER | RECOVERY WT % | MAGNETIC SUSCEPTIBILITY MICRO CC/GM | ASH WT % | SULFUR WT % |
|---|---|---|---|---|
| 0 | 0.00 | | | |
| 1 | 6.76 | +0.99 | 26.09 | 11.80 |
| 2 | 19.58 | +0.09 | 13.71 | 6.04 |
| 3 | 24.46 | +1.06 | 29.48 | 13.70 |
| 4 | 29.36 | +1.47 | 35.97 | 18.46 |
| 5 | 8.86 | +1.45 | 36.21 | 17.44 |
| 6 | 4.64 | +1.57 | 37.57 | 17.13 |
| 7 | 6.35 | +1.62 | 39.17 | 17.98 |
| 8 | 0.00 | | | |
| | Composite | +1.08 | 29.66 | 14.23 |

Magnetic Susceptibility = −0.68 + 0.062A − 0.0046S ($10^{-6}$ cc/gm),
Correlation Coefficient = 0.99

The ash and sulfur of the products of separation of each of the three fractions make a positive correlation with the magnetic susceptibility except for the clean coal fraction. For this fraction, the ash makes a negative contribution to the magnetic susceptibility indicating that mineral matter separations from that fraction are removing diamagnetic minerals as was observed in the tray MagnetoGraph for this fraction.

The elements of the above tables are combined in Table XXVI which is the analytical basis for the MagnetoGraph of the 30×50 mesh fraction prepared by the free fall method.

TABLE XXVI

MagnetoGraph Data, 30 × 50 Mesh Fraction
Lower Kittanning Seam Coal from Clearfield County, PA

| Fraction | Magnetic Susceptibility ($10^{-6}$ cc/gm) | Ash Wt. % | Sulfur Wt. % | ← Distribution → Recovery Wt. % | Ash Wt. % | Sulfur Wt. % |
|---|---|---|---|---|---|---|
| C2 | −0.49 | 4.86 | 1.72 | 48.15 | 21.24 | 17.46 |
| C1 | −0.42 | 5.74 | 2.17 | 1.63 | 0.85 | 0.74 |
| C3 | −0.358 | 8.13 | 2.74 | 9.63 | 7.11 | 5.57 |
| M2 | −0.356 | 7.41 | 2.67 | 10.48 | 7.05 | 5.90 |
| C5 | −0.27 | 8.34 | 3.19 | 0.89 | 0.67 | 0.60 |
| C6 | −0.02 | 10.13 | 3.83 | 0.36 | 0.33 | 0.29 |
| R2 | +0.09 | 13.71 | 6.04 | 1.90 | 2.36 | 2.42 |
| M3 | +0.11 | 15.03 | 5.75 | 9.82 | 13.40 | 11.91 |
| C7 | +0.20 | 14.71 | 5.76 | 0.28 | 0.37 | 0.34 |
| M1 | +0.21 | 15.04 | 6.43 | 0.93 | 1.26 | 1.25 |
| C4 | +0.50 | 12.90 | 5.63 | 1.65 | 1.94 | 1.96 |
| M4 | +0.92 | 27.47 | 13.32 | 2.97 | 7.40 | 8.34 |
| R1 | +0.99 | 26.09 | 11.80 | 0.66 | 1.55 | 1.63 |
| R3 | +1.058 | 29.48 | 13.70 | 2.37 | 6.35 | 6.86 |
| M5 | +1.06 | 27.84 | 12.70 | 0.85 | 2.14 | 2.27 |
| M6 | +1.24 | 33.22 | 14.76 | 0.45 | 1.36 | 1.41 |
| R5 | +1.45 | 36.21 | 17.44 | 0.86 | 2.83 | 3.16 |
| R4 | +1.47 | 35.97 | 18.46 | 2.85 | 9.30 | 11.09 |
| M7 | +1.57 | 36.79 | 16.35 | 0.58 | 1.94 | 2.01 |
| R6 | +1.573 | 37.57 | 17.13 | 0.45 | 1.53 | 1.62 |
| R7 | +1.62 | 39.17 | 17.98 | 0.62 | 2.19 | 2.34 |
| POLE | +18.7 | 45.76 | 31.39 | 1.64 | 6.81 | 10.85 |
| Composite | −0.142 w/o pole | 11.02 | 4.74 | | | |

Magnetic Susceptibility = 0.71 + 0.054A + 0.015S ($10^{-6}$ cc/gm).
Correlation Coefficient = 0.98

Figure 27:
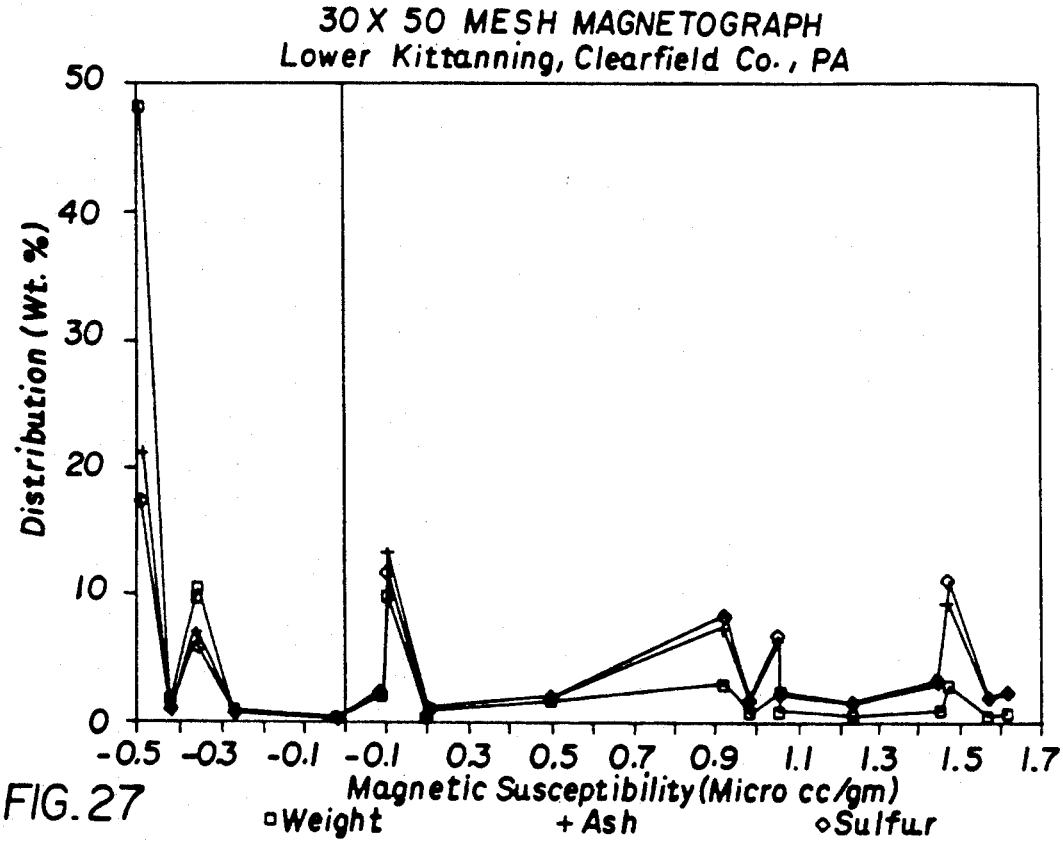
FIG. 27 illustrates a MagnetoGraph prepared according to a preferred embodiment of the present invention, of 30×50 Lower Kittanning seam coal, free fall.

The MagnetoGraph is shown in FIG. 27. The MagnetoGraph for the 30×50 mesh fraction of the Lower Kittanning seam coal prepared under free fall conditions is similar to that of FIG. 7 which was prepared with use of the tray configuration. The free fall MagnetoGraph shows more resolution, however, because of the greater amount of material employed. Further, the free fall MagnetoGraph shows ash and sulfur components in the diamagnetic fractions which can be removed by magnetic methods.

Using the MagnetoGraph data, one can develop information on the recovery of clean coal by the dry magnetic method. This information is shown in Table XXVII for the 30×50 mesh fraction of the Lower Kittanning seam coal. In the tables, final clean coal, middling, and refuse products have been identified using the magnetic susceptibility, ash, and sulfur criteria used in defining the feeds for the second pass separation.

TABLE XXVII

Recovery Data, 30 × 50 Mesh Fraction
Lower Kittanning Seam Coal from Clearfield County, PA

| Fraction | Magnetic Susceptibility ($10^{-6}$ cc/gm) | ← Cumulative → Rec. Wt. % | Ash Wt. % | Sulfur Wt. % | ← Reduction → Ash Wt. % | Sulfur Wt. % |
|---|---|---|---|---|---|---|
| Clean Coal | −0.49 | 48.15 | 4.86 | 1.72 | 55.88 | 63.73 |
| | −0.42 | 49.77 | 4.89 | 1.73 | 55.62 | 63.42 |
| | −0.358 | 59.41 | 5.41 | 1.90 | 50.85 | 59.99 |
| | −0.356 | 69.89 | 5.71 | 2.01 | 48.13 | 57.55 |
| | −0.27 | 70.77 | 5.75 | 2.03 | 47.83 | 57.24 |
| | −0.02 | 71.13 | 5.77 | 2.04 | 47.63 | 57.04 |
| Middlings | +0.097 | 3.03 | 5.98 | 2.14 | 45.76 | 54.85 |
| | +0.11 | 82.85 | 7.05 | 2.57 | 36.01 | 45.83 |
| | +0.20 | 83.13 | 7.07 | 2.58 | 35.78 | 45.61 |
| | +0.21 | 84.07 | .16 | 2.62 | 34.99 | 44.71 |
| | +0.50 | 85.71 | 7.27 | 2.68 | 33.98 | 43.49 |
| Refuse | +0.92 | 88.68 | 7.95 | 3.04 | 27.84 | 35.98 |
| | +0.99 | 89.33 | 8.08 | 3.10 | 26.64 | 34.62 |
| | +1.058 | 91.70 | 8.64 | 3.37 | 21.61 | 28.84 |

TABLE XXVII-continued

Recovery Data, 30 × 50 Mesh Fraction
Lower Kittanning Seam Coal from Clearfield County, PA

| Fraction | Magnetic Susceptibility ($10^{-6}$ cc/gm) | ← Cumulative → Rec. Wt. % | Ash Wt. % | Sulfur Wt. % | ← Reduction → Ash Wt. % | Sulfur Wt. % |
|---|---|---|---|---|---|---|
| | +1.06 | 92.55 | 8.81 | 3.46 | 20.01 | 27.04 |
| | +1.24 | 93.00 | 8.93 | 3.52 | 18.93 | 25.88 |
| | +1.45 | 93.86 | 9.18 | 3.64 | 16.67 | 23.19 |
| | 1.47 | 96.71 | 9.97 | 4.08 | 9.50 | 13.99 |
| | +1.57 | 97.29 | 10.03 | 4.15 | 8.05 | 12.44 |
| | +1.573 | 97.74 | 10.26 | 4.21 | 6.90 | 11.18 |
| | +1.62 | 98.36 | 10.44 | 4.30 | 5.26 | 9.36 |
| POLE | +18.7 | 100.00 | 11.02 | 4.74 | 0.00 | 0.00 |

Figure 28:
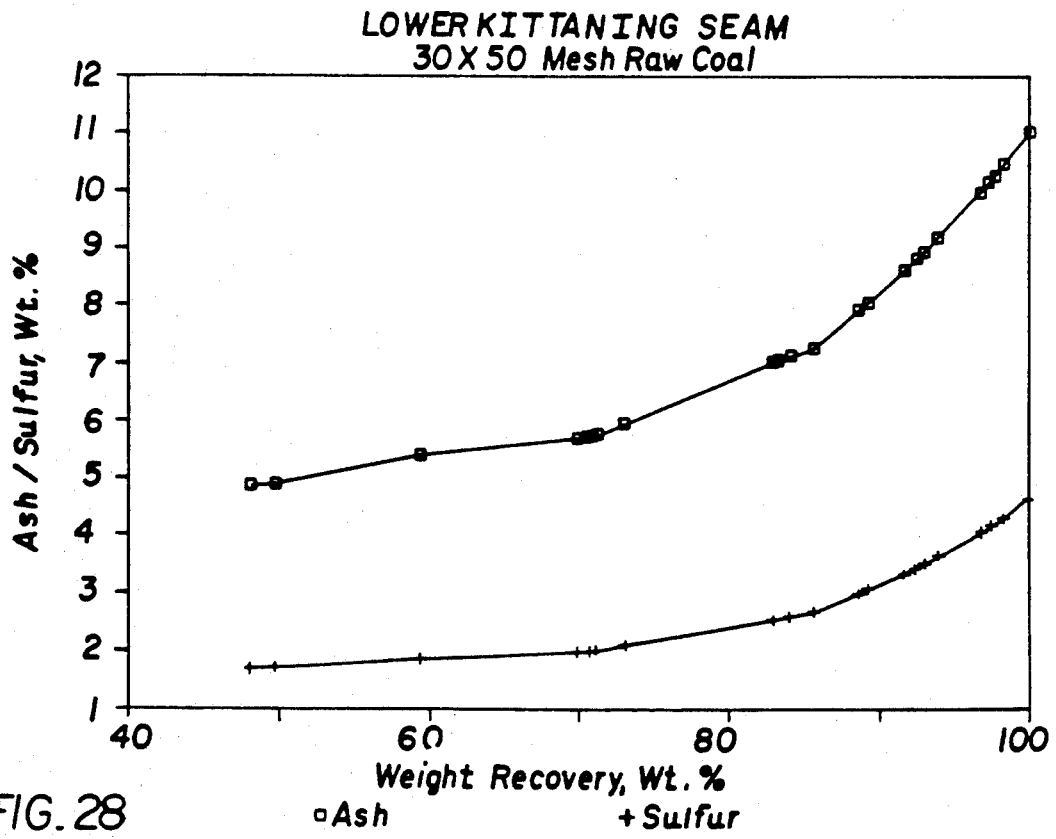
FIG. 28 illustrates ash and sulfur recovery by weight, Lower Kittanning seam coal, free fall.
Figure 29:
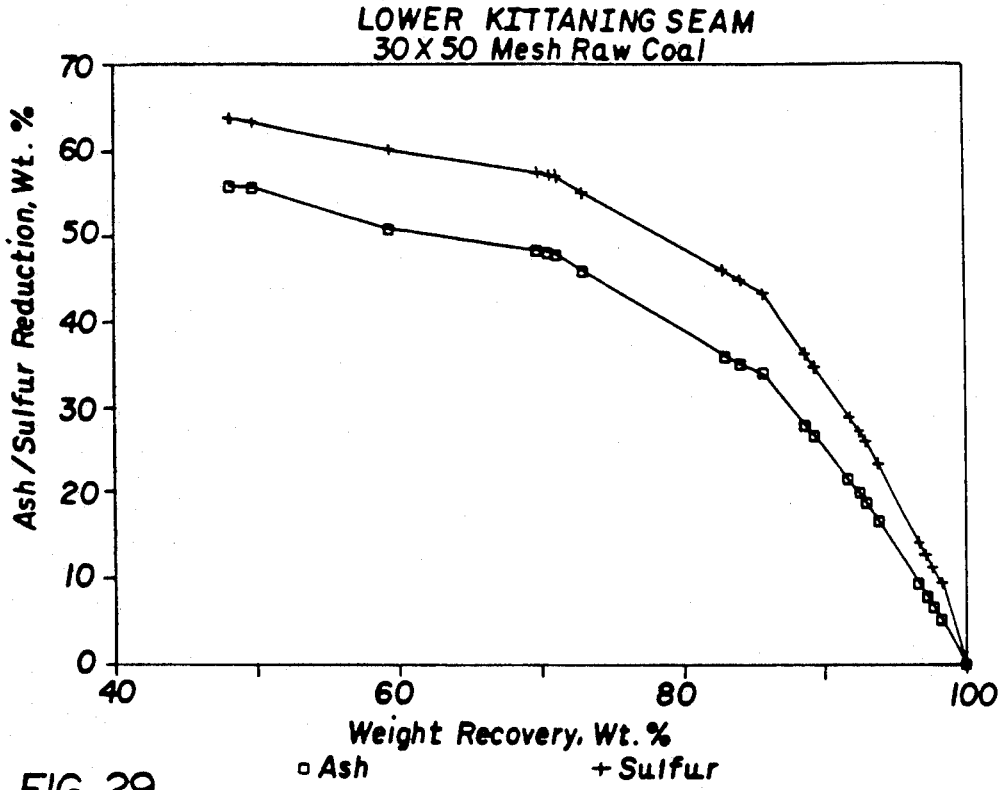
FIG. 29 illustrates percentage reduction of ash and sulfur, Lower Kittanning seam coal, free fall.

The data of Table XXVII are summarized in FIGS. 28 and 29. FIG. 28 relates the ash and sulfur levels prepared for this coal by the dry magnetic method to the weight recovery and FIG. 29 shows this information in terms of percentage reduction in ash and sulfur of the feed coal. The characteristics of the final clean coal, middling, and refuse products identified on the basis of a range of magnetic susceptibilities are given in Table XXVIII.

Using this method, magnetic components are grouped on the basis of magnetic susceptibility, ash, and sulfur, we have processed many coals with particle size ranges from 8 mesh topsize to 325 mesh bottomsize and have achieved ash and sulfur rejections characteristic of those shown for the above example. Magnetic susceptibility is an effective control parameter for magnetic separation and its use in multiple pass beneficiation can serve to increase weight recovery and increase ash and sulfur rejection.

TABLE XXVII

Product Data, 30 × 50 Mesh Fraction Lower Kittanning Seam Coal from Clearfield County, PA

| Fraction | Magnetic susceptibility (10−6 cc/gm) | Recovery Wt. % | Ash Wt. % | Sulfur Wt. % |
|---|---|---|---|---|
| Clean Coal | −0.45 | 71.13 | 5.77 | 2.04 |
| Middling | +0.16 | 14.58 | 14.61 | 5.82 |
| Refuse | 3.21 | 14.30 | 33.46 | 17.11 |

USE OF MAGNETOGRAPH

The information contained in the MagnetoGraph is used to specify the design and operating procedure for innovative magnetic separators using the following procedure.

First, ranges of the magnetic susceptibility in which separations are to be carried out are identified in exploratory magnetic separation experiments for the purpose of constructing the MagnetoGraph.

The MagnetoGraph shows directly where the separation or separations must be accomplished and establishes the range of magnetic energy gradients that is required. For example, separation of iron pyrite from coal requires separation of paramagnetic material of susceptibility ranging from $+0.1\times10^{-6}$ cc/gm to about $+0.5\times10^{-6}$ cc/gm whereas separation of sulfates may be accomplished at magnetic susceptibilities up to 1.5 to $2.5\times10^{-6}$ cc/gm. As was shown in the examples employing tray separations, these different applications require use of magnetic separators capable of producing magnetic energy gradients ranging from nominally 10 million Gauss$^2$/cm to 100 million Gauss$^2$/cm or greater.

Secondly, the MagnetoGraph data is used to construct performance curves which relate quality of the products of magnetic separation to weight recovery.

These curves establish the first test of practicality of the application of dry magnetic separation methods for particular applications. For the case of coal, for example, curves such as product ash and sulfur levels and percent ash and sulfur reduction versus weight recovery are used in economic tradeoff studies to determine the feasibility of the magnetic application. Further, particle size effects are an important part of these tradeoff studies since they provide information on effects of mineral liberation on separations efficiency and hence on process costs.

Thirdly, the MagnetoGraph and performance data is combined with information on the scale of application to establish technical parameters for the magnetic separator.

This work involves modeling of the magnetic separation process and is specific to dry separation of weakly magnetic materials. The work establishes a size range for the magnetic separator given input on magnetic susceptibility and magnetic energy gradient requirements.

Since separator characteristics can vary greatly depending upon magnetic susceptibility, particle size, throughput, etc., it is necessary to have a method for relating magnetic separator physical characteristics to the magnetic and flow properties of the system. This is accomplished by modeling particle flow through the separator where magnetic, gravitational, and aerodynamic forces are at play.

The rate at which mass evolves from the separator can be related to system parameters through the following expression:

$$\dot{M} = mass\ flow\ rate = \rho f_p V_y GD \quad (1)$$

In Eq. (1) $\rho$ is the particle density, $f_p$ is the fractional volume occupancy of the particles at the separator exit, $$f_p = (n_p m_p)/\rho$$

where $n_p$ is the number of particles per unit volume, $m_p$ is the particle mass, $V_y$ is the vertical component of the particle velocity at the exit, G is the width of the particle stream (this is the pole gap in a conventional electromagnet separator) and D is the lateral spread of particles emerging from the separator.

To be separated from the bulk flow, a weakly paramagnetic mineral particle must work its way across the stream of diamagnetic particles. If one assumes that the paramagnetic particles perform a series of collisions with the diamagnetic particles which stop their motions and that they are re-accelerated by the magnetic force, and that in this sequence neither particle reaches terminal velocity, then one can introduce a mean free path, $\lambda = 1/n_p^{\frac{1}{3}} = V_x T_c$ where $V_x$ is the average velocity of deflection and $T_c$ is the mean time between collisions.

Using the relationship, $$\text{Magnetic acceleration} = fm\ \chi HdH/dX \quad (3)$$

relating particle magnetic susceptibility $\chi$ (cc/gm), and the magnetic energy gradient, HdH/dX, one sees that the deflection D is given in terms of a deflection $Do = f_m L/g$ for non interacting particles and a term, $\sqrt{g\lambda/f_m L}$ expressing the effects of particle interaction, $$D = \sqrt{g\lambda/f_m L} \cdot D_O$$

If D is large enough to assure separation, then the mass throughput can be expressed as $$\dot{M}(\text{gm/sec}) = GL\rho\sqrt{(4\pi/3)^{\frac{1}{3}}\ HdH/dX\ rf_p^{5/3}} \quad (5)$$

The throughput is given in terms of three types of parameters: the first type is a magnet parameter which is given by the product of the surface area, GD, exposed to the gradient magnetic field and the square root of the magnetic energy gradient produced by the magnet system, HdH/dX; secondly, there are parameters which describe the particle system being separated including the density, the square root of the product of the magnetic susceptibility and the particle radius; and lastly, a flow parameter expressing the dispersion of the particles in the falling stream $(4\pi/3)^{\frac{1}{3}} * f_p 5/3$. For the particle sizes employed in the work reported here, the parameter $f_p$, has been estimated at 0.08 for the Frantz Isodynamic Separator and the mean free path for coal particles in the −30 mesh size range has been estimated at 0.08 cm.

Eq. (5) can be rewritten to show the effects of particle interaction:

$$\dot{M} = \sqrt{2/g} \cdot f_p f_m GL^{2/3} \cdot \sqrt{g\lambda/f_m L} \quad (6)$$

To first approximation, the magnetic separator throughput under conditions of good separation is independent of the local acceleration due to gravity.

MAGNETIC SEPARATOR SYSTEMS

The handling of large throughputs by magnetic systems requires physically large magnet structures. When the material to be processed is also feebly magnetic, then the use of magnets producing high values of the magnetic energy gradient extending throughout large magnetized volumes will be required. This virtually rules out the use of conventional electromagnets. The most economical way to magnetize large volumes is with the use of superconductive magnets. The following example illustrates how the information developed in the MagnetoGraph assessment is used to specify the magnetic separator in innovative applications.

Figure 30A:
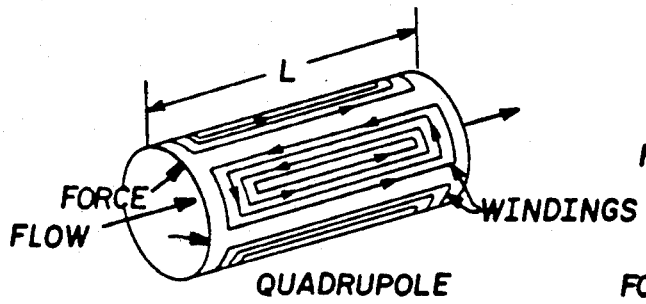
FIGS. 30A, 30B and 30C illustrate different magnet structures useful in practicing a preferred embodiment of the present invention.
Figure 30B:
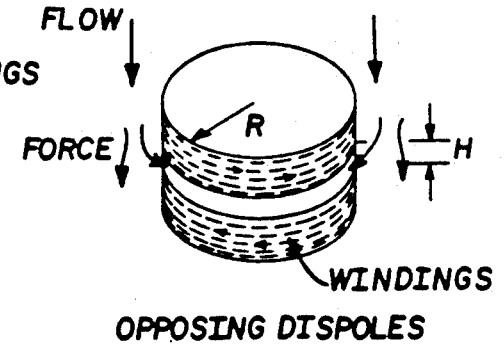
Figure 30C:
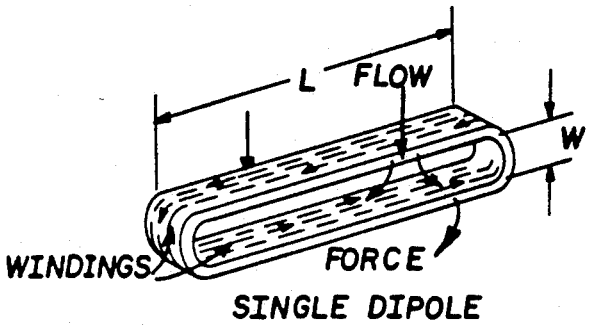

Several types of superconductive magnets are now being considered for application to separation of weakly magnetic particles. These magnet structures would be good candidates for extraterrestrial application. By way of example, the characteristics of three of these magnets are compared in FIG. 30.

A quadrupole magnet structure has been patented by Bethlehem Steel for use in water cleanup applications. (W. M. Aubrey, Jr., et al, U.S. Pat. No. 3,608,718 (Sept. 28, 1971.) A superconductive quadrupole adapted from beam focusing applications has been investigated by Argonne National Laboratory for use in desulfurizing Illinois coal. (R. D. Doctor, et al, in Recent Advances in Separation TechniquesIII. edited by N. N. Li, AIChE Symposium Series 82 (250), pp. 154–168 (1986). The quadrupole produces a constant magnetic field gradient throughout the working volume.

An opposing dipole arrangement has been studied at the Oak Ridge National Laboratory and by investigators at the University of London (E. Cohen et al, Proc. of Electrical and Magnetic Separation and Filtration Technology (307th Event) SCK/ECN, Belgian Research Institute of Atomic Energy, Antwerp, pp. 85-92 (May, 1984) and at Oxford Instruments in Great Britain. The magnetic flux passing through each of the dipoles is made to diverge outward through the circumferential area between the opposing poles. This is the region of high magnetic energy gradient.

Cryogenic Consultants, Ltd., of London, England, has tested a novel squashed dipole in OGMS treatment of phosphate ores at Foskor in South Africa at 60 tons per hour throughput. (J. A. Good and K. White, Journal de Physique, Colloque Cl, supplement au No. 1, Tome 45, pp. Cl-759-C-1761 (janvier, 1984). This magnet is a single dipole. The region of high magnetic energy gradient exists on either side of the area enclosed by the opposite legs of the dipole structure.

The surface area and magnetic energy gradients for laboratory scale working versions of each of the three magnets is compared in Table XXIX.

TABLE XXIX

COMPARISON PARAMETERS FOR SUPERCONDUCTING MAGNETIC SEPARATORS

| | GD ($cm^2$) | HdH/dX ($10-6$ $gauss^2/cm$) |
|---|---|---|
| Quadrupole | 8796 | 216 |
| Cusp | 1056 | 256 |
| Dipole | 6018 | 256 |

Using Equation (5), the throughput can be estimated for each of the three laboratory magnet systems for the two comparison cases, coal desulfurization and recovery of anorthite from lunar soil. Calculations for anorthite recovery from plagioclase, density 3 gm/cc, $\chi=0.75\times10^{-6}$ cc/gm, and for iron pyrite separation from coal, density 1.4 gm/cc, $\chi=0.5\times10^{-6}$ cgs/gm, are compared in Table XXIX. The particle size is assumed to be the same for each application and is $r=75\times10^{-4}$ cm.

TABLE XXX

COMPARISON OF CALCULATED THROUGHPUTS FOR SUPERCONDUCTING MAGNETIC SEPARATORS

| Application | Throughput (TPH) | | |
|---|---|---|---|
| Dipole | Quadrupole | Cusp | |
| Anorthite from Plagioclase | 49 | 6 | 37 |

TABLE XXX-continued

COMPARISON OF CALCULATED THROUGHPUTS FOR SUPERCONDUCTING MAGNETIC SEPARATORS

| Application | Throughput (TPH) | | |
|---|---|---|---|
| Dipole | Quadrupole | Cusp | |
| Iron Pyrite from Coal | 5 | 0.5 | 4 |

Using the information in Tables XXIX and XXX, preliminary estimates of the costs to build and to operate the three superconductive magnet systems in the lunar anorthite and coal applications would then be prepared based on cost estimates to build the magnets based on scaled dimensions of the laboratory separators.

This cost estimate would then provide a basis on which to choose between the various options.

The procedure of this patent gives a systematic basis for preparation of an analytical assessment of the feasibility of applying dry magnetic separation methods to a wide variety of significant applications.

Although the invention has been described in detail in the foregoing for the purpose of illustration, it is to be understood that such detail is solely for that purpose and that variations can be made therein by those skilled in the art without departing from the spirit and scope of the invention as defined by the claims.

I claim:

1. A method of removing magnetic material from a raw sample containing said magnetic material comprising the steps of:

a. passing said raw sample through a refining means, thereby producing a refined raw sample having a maximum particle size of about 8 mesh;

b. screening said refined raw material into at least two fractions, one said fraction comprising a coarse fraction, and at least another said fraction comprising a fine fraction;

c. beneficiating said coarse fraction by passing said coarse fraction through a first magnetic separator means, thereby removing magnetic material from said coarse fraction and producing a coarse product fraction, a first middling fraction, and a first refuse fraction; and d. beneficiating said fine fraction by passing said fine fraction through a second magnetic separator means, thereby producing a fine product fraction, a second. middling fraction, and a second refuse fraction.

2. The method of claim 1 wherein said raw sample comprises coal.

3. The method of claim 1 wherein said raw sample consists of soil obtained from and indigenous to earth's moon.

4. The method of claim 1 wherein said coarse product fraction and said fine product fraction contain anorthite.

5. The method of claim 1 wherein said fine product fraction and said coarse product fraction comprise at least 70% by volume pure anorthite.

* * * * *